US008109599B2

(12) United States Patent
Inoue

(10) Patent No.: US 8,109,599 B2
(45) Date of Patent: Feb. 7, 2012

(54) LIQUID EJECTION APPARATUS AND METHOD OF INSPECTING CLEANING APPARATUS OF LIQUID EJECTION APPARATUS

(75) Inventor: Hiroshi Inoue, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 472 days.

(21) Appl. No.: 12/142,576

(22) Filed: Jun. 19, 2008

(65) Prior Publication Data

US 2008/0316253 A1 Dec. 25, 2008

(30) Foreign Application Priority Data

Jun. 20, 2007 (JP) ..... 2007-162678

(51) Int. Cl.
*B41J 2/165* (2006.01)

(52) U.S. Cl. ..... 347/33

(58) Field of Classification Search ..... None
See application file for complete search history.

(56) References Cited

U.S. PATENT DOCUMENTS

| | | | | |
|---|---|---|---|---|
| 6,056,387 | A * | 5/2000 | Kaneko | 347/23 |
| 7,008,039 | B2 * | 3/2006 | Yamazaki | 347/33 |
| 2002/0085058 | A1 * | 7/2002 | Griffin et al. | 347/28 |
| 2006/0066665 | A1 | 3/2006 | Kachi et al. | |

FOREIGN PATENT DOCUMENTS

JP 2006/095881 A1 4/2006

* cited by examiner

*Primary Examiner* — Matthew Luu
*Assistant Examiner* — Alejandro Valencia
(74) *Attorney, Agent, or Firm* — Birch, Stewart, Kolasch & Birch, LLP

(57) ABSTRACT

The liquid ejection apparatus has: a liquid ejection head which includes a nozzle plate forming a nozzle surface in which nozzles ejecting droplets of a first liquid are provided; a wiping member which wipes the nozzle surface; an edge determination device which includes a determination plate with which a front tip portion of the wiping member wiping the nozzle surface can make contact, and determines an edge shape of the front tip portion of the wiping member according to a state of the determination plate; and a judgment device which judges timing of replacing the wiping member, according to the edge shape determined by the edge determination device.

5 Claims, 17 Drawing Sheets

LIQUID EJECTION APPARATUS AND METHOD OF INSPECTING CLEANING APPARATUS OF LIQUID EJECTION APPARATUS

BACKGROUND OF THE INVENTION

1. Field of the Invention

The present invention relates to a liquid ejection apparatus and a method of inspecting a cleaning apparatus thereof, and more particularly to a liquid ejection apparatus having a cleaning apparatus which wipes an ejection port surface of the liquid ejection apparatus with a wiping member, and to a method of inspecting the cleaning apparatus.

2. Description of the Related Art

Conventionally, a liquid ejection apparatus, such as an inkjet recording apparatus, is known, which comprises an inkjet head (liquid droplet ejection head) having an arrangement of a plurality of nozzles (liquid droplet ejection ports) which eject liquid, such as an ink, in the form of liquid droplets, and which forms images on a recording medium by ejecting ink (ink droplets) from the nozzles toward the recording medium while causing the inkjet head and the recording medium to move relatively to each other.

The inkjet recording apparatus ejects ink from the nozzles toward a recording medium conveyed in the near vicinity of the nozzles, and hence the ink ejected onto the recording medium may be propelled back and adhere to the nozzle surface (the surface in which the nozzles of the liquid droplet ejection head are formed), a portion of the ejected ink may remain on the nozzle surface, and dirt, such as paper dust from the conveyed recording medium, may adhere to the nozzle surface. When the nozzle surface becomes soiled in this way, then ejection defects arise in that the direction of flight of the ink droplets ejected from the nozzles is bent, or the nozzles become blocked and ink can no longer be ejected from the nozzles. Therefore, in the related art, various methods are known for cleaning the nozzle surface.

For example, in the related art, a head cleaning method is widely used in which the nozzle surface is wiped with a blade (wiper) which is made of a soft material, such as rubber, thereby removing adhering material about the periphery of the nozzles. However, in this method, since the wiping is carried out while the blade makes contact with the nozzle surface, then the blade gradually wears or deteriorates. In the case of a blade which has suffered deterioration in this way, in addition to decline in the cleaning properties, depending on the circumstances, there are also possibilities that the nozzle surface will be damaged by the worn blade, and that the surface treatment, such a lyophobic treatment, on the nozzle surface, will be degraded.

In response to this, Japanese Patent Application Publication No. 2006-95881 discloses a cleaning performance identification device which identifies the cleaning performance of a wiping device including a blade member. The cleaning performance identification device is composed in such a manner that the cleaning performance is restored in accordance with the identified cleaning performance. In particular, an abutting pressure determination device is provided which determines the abutting pressure between the ejection surface and the blade member. By measuring this abutting pressure, the amount of wear of the blade member is identified and the abutting conditions of the blade member are controlled accordingly.

However, the technology described in Japanese Patent Application Publication No. 2006-95881 determines the abutting pressure of the whole of the edge portion of a blade member; therefore, while it is able to judge decline in cleaning properties due to overall wear in the edge portion of the blade member, it is not able to determine slight partial changes in the shape of the edge portion of the blade member.

On the other hand, if the edge portion of the blade member is worn locally, creating, for example, a wedge shape, due to a solid body attached to the nozzle surface or the step difference in the edge or the counter-bore sections of the nozzles, or the like, then the cleaning properties of the nozzle surface decline markedly since it becomes difficult to wipe the nozzle surface with the worn portions of the blade, hence producing stripe-shaped unwiped regions on the surface in these regions.

SUMMARY OF THE INVENTION

The present invention has been contrived in view of these circumstances, an object thereof being to provide a liquid ejection apparatus comprising a cleaning apparatus, and a method of inspecting the cleaning apparatus, whereby a slight partial change in the edge shape of the tip section of a wiping member which wipes a nozzle surface can be determined, and furthermore the replacement timing for the wiping member can be predicted and the frequency of replacement of the wiping member can be reduced.

In order to attain the aforementioned object, the present invention is directed to a liquid ejection apparatus, comprising: a liquid ejection head which includes a nozzle plate forming a nozzle surface in which nozzles ejecting droplets of a first liquid are provided; a wiping member which wipes the nozzle surface; an edge determination device which includes a determination plate with which a front tip portion of the wiping member wiping the nozzle surface can make contact, and determines an edge shape of the front tip portion of the wiping member according to a state of the determination plate; and a judgment device which judges timing of replacing the wiping member, according to the edge shape determined by the edge determination device.

Consequently, it is possible to determine the edge shape of the front tip portion of the wiping member accurately, and therefore it is possible to judge the replacement timing of the wiping member accurately, as well as ensuring stable wiping characteristics, reducing the replacement frequency of the wiping member, and enhancing productivity.

Desirably, the edge determination device comprises: an imaging device capturing an image of a contact trace left on the determination plate, the contact trace being created when the front tip portion of the wiping member is brought into contact with the determination plate so that a second liquid adhering to the front tip portion of the wiping member is deposited on the determination plate; and an image processing unit which processes the captured image of the contact trace.

By measuring the edge trace which has been transferred onto the determination plate in this way, rather than directly measuring the edge shape of the front tip portion of the wiping member, it is possible to determine a slight change in the edge shape.

Desirably, the second liquid adhering to the front tip portion of the wiping member is the first liquid which has been ejected from the liquid ejection head and which has become attached to the front tip portion due to wiping the nozzle surface by the wiping member.

By depositing the liquid (ink) ejected from the liquid ejection head, which has been wiped by the wiping member, directly onto the determination plate in this way, it is possible to determine the edge shape by means of a simple apparatus composition.

Desirably, the liquid ejection apparatus further comprises an application device which applies an application liquid to the front tip portion of the wiping member, and the second liquid which adheres to the front tip portion of the wiping member is the application liquid which is applied by the application device.

Desirably, the application liquid is a liquid ejected from the liquid ejection head.

The application liquid may be the same in the type as the first liquid ejected from the liquid ejection head.

Desirably, the application liquid is lower in at least one of surface tension and viscosity than the first liquid ejected from the liquid ejection head.

By selecting an application liquid which is suitable for the edge determination in accordance with the type of liquid (ink) ejected by the liquid ejection head, it is possible readily to determine the edge.

Desirably, the judgment device compares a length of a missing edge part of the edge shape determined by the edge determination device, with a threshold value, to judge the timing of replacing the wiping member.

Desirably, the judgment device compares a ratio between a maximum value and a minimum value of width of the edge shape determined by the edge determination device, with a threshold value, to judge the timing of replacing the wiping member.

By judging the replacement timing of the wiping member from the width of the edge in this way, it is possible to judge the replacement timing accurately, as well as ensuring stable wiping characteristics in the wiping member.

Desirably, the edge determination device further includes: a plurality of piezoelectric elements which generate electrical signals when the wiping member makes contact with the determination plate; and a signal processing unit which converts the electrical signals generated by the plurality of piezoelectric elements into image information.

Since the edge shape is determined by measuring the pressure, rather than depositing liquid on the determination plate and determining the trace of the liquid, it is not necessary to include processing for cleaning the determination plate on which liquid has been deposited and applying an application liquid to the wiping member, and so on, and therefore the composition of the apparatus is simplified.

In order to attain the aforementioned object, the present invention is also directed to a method of inspecting a cleaning apparatus of a liquid ejection apparatus, comprising the steps of wiping a nozzle surface of a nozzle plate where nozzles ejecting droplets of liquid are formed, of a liquid ejection head, by means of a wiping member of the cleaning apparatus of the liquid ejection head; bringing a front tip portion of the wiping member which has wiped the nozzle surface, into contact with a determination plate; determining an edge shape of the front tip portion of the wiping member by determining a contact trace of the front tip portion left on the determination plate; and judging timing for replacing the wiping member according to the determined edge shape of the front tip portion of the wiping member.

Consequently, it is possible to determine the edge shape of the front tip portion of the wiping member accurately, and therefore it is possible to judge the replacement timing of the wiping member accurately, as well as ensuring stable wiping characteristics, reducing the replacement frequency of the wiping member, and enhancing productivity.

As described above, according to the present invention, it is possible to determine the edge shape of the front tip portion of the wiping member accurately, and therefore it is possible to judge the replacement timing of the wiping member accurately, as well as ensuring stable wiping characteristics, reducing the replacement frequency of the wiping member, and enhancing productivity.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
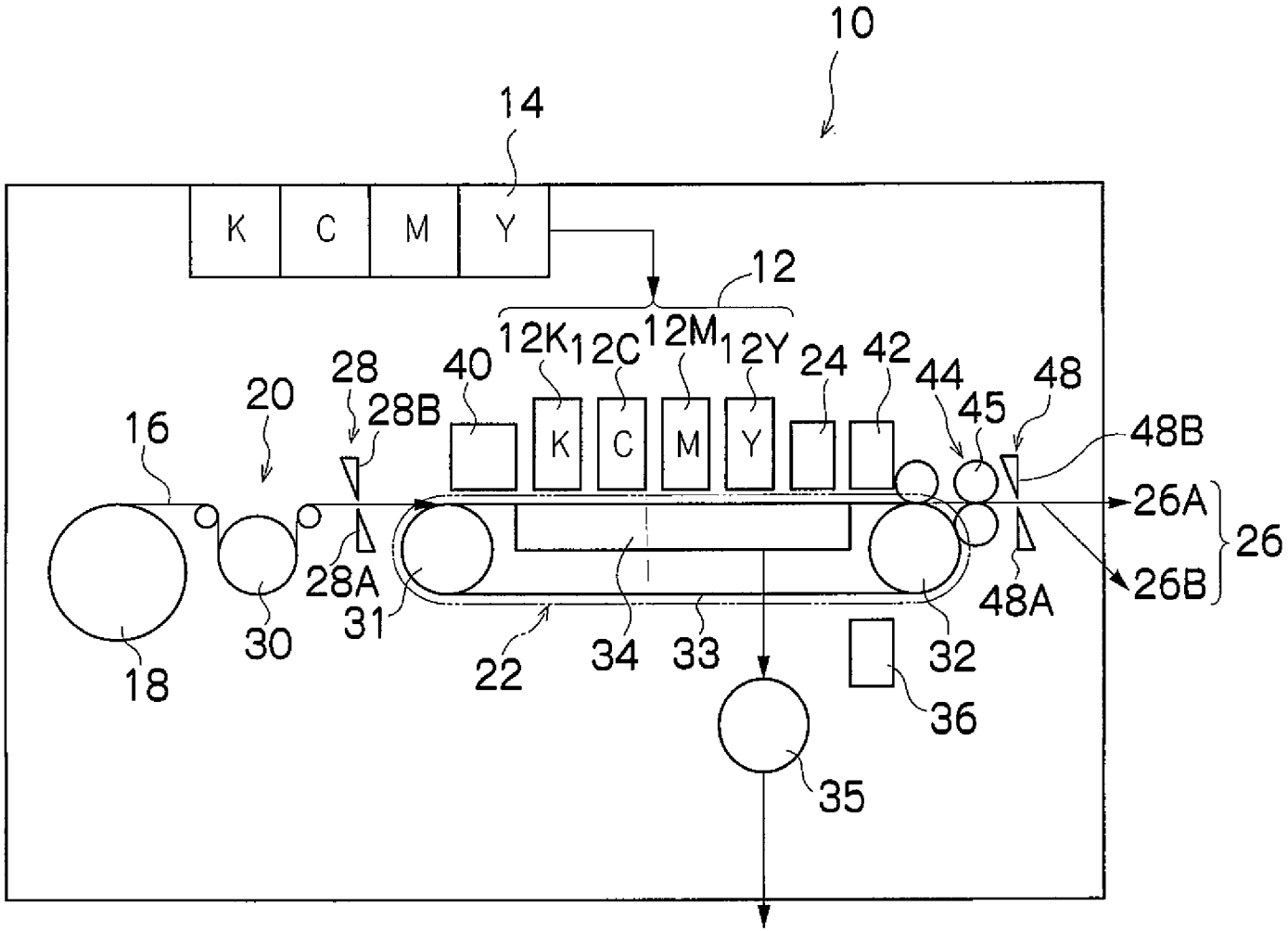
FIG. 1 is a general compositional view showing an embodiment of an inkjet recording apparatus using an inkjet head relating to an embodiment of the present invention.

FIG. 1 is a general schematic drawing of a first embodiment of an inkjet recording apparatus which forms a liquid ejection apparatus relating to an embodiment of the present invention.

As shown in FIG. 1, the inkjet recording apparatus 10 comprises: a print unit 12 having a plurality of print heads (inkjet recording heads) 12K, 12C, 12M, and 12Y for respective ink colors; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the print unit 12; and a paper output unit 26 for outputting image-printed recording paper (printed matter) to the exterior.

In FIG. 1, a magazine for rolled paper (continuous paper) is shown as an example of the paper supply unit 18; however, a plurality of magazines with paper differences such as paper width and quality may be jointly provided. Moreover, papers may be supplied with cassettes that contain cut papers loaded in layers and that are used jointly or in lieu of the magazine for rolled paper.

In the case of the configuration in which roll paper is used, a cutter 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite to the curl direction in the magazine. At this time, the heating temperature is preferably controlled in such a manner that the recording paper 16 has a curl in which the surface on which the print is to be made is slightly rounded in the outward direction.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print unit 12 and the sensor face of the print determination unit 24 forms a plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the print unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job and the like are performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, and a combination of these. In the case of the configuration in which the belt 33 is nipped with the cleaning rollers, it is preferable to make the line velocity of the cleaning rollers different from that of the belt 33 to improve the cleaning effects.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable as per an embodiment of the present invention.

A heating fan 40 is disposed on the upstream side of the print unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
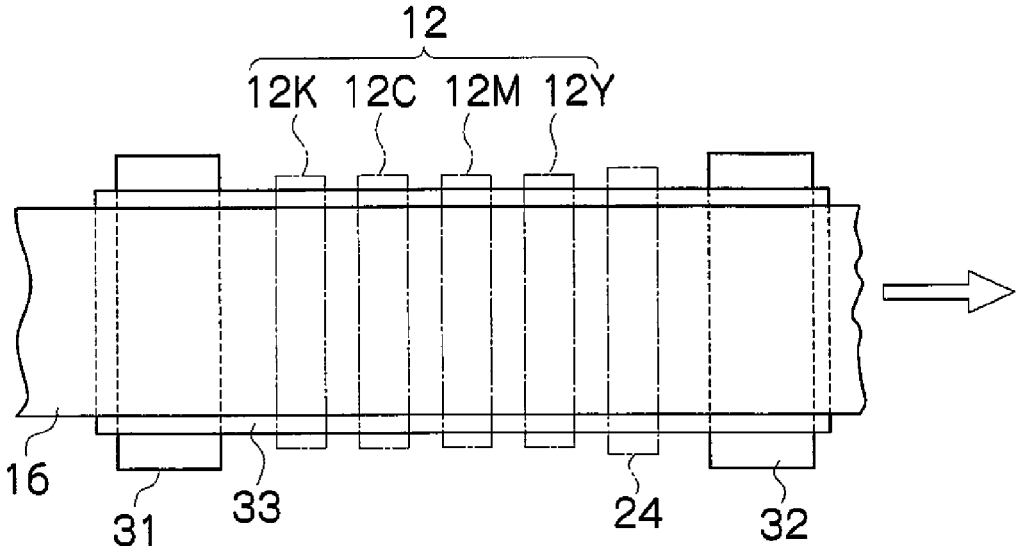
FIG. 2 is a plan view of the principal part of the peripheral area of a print unit in the inkjet recording apparatus illustrated in FIG. 1.

The print unit 12 is a so-called "full line head" in which a line head having a length corresponding to the maximum paper width is arranged in a direction (main scanning direction) that is perpendicular to the paper conveyance direction (sub-scanning direction) (see FIG. 2).

Each of the print heads 12K, 12C, 12M, and 12Y is constituted by a line head, in which a plurality of ink ejection ports (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in the order of black (K), cyan (C), magenta (M), and yellow (Y) from the upstream side (left side in FIG. 1), along the conveyance direction of the recording paper 16 (paper conveyance direction). A color image can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relative to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in the direction (main-scanning direction) that is perpendicular to the paper conveyance direction.

Here, the terms of "main scanning direction" and "sub-scanning direction" are used in the following senses. More specifically, in a full-line head comprising rows of nozzles corresponding to the entire width of the recording paper, the "main scanning" is defined as printing a line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by the main scanning action (the lengthwise direction of the band-shaped region thus recorded) is called the "main scanning direction".

On the other hand, "sub-scanning" is defined as to repeatedly perform printing of a line (a line formed of a row of dots, or a line formed of a plurality of rows of dots) formed by the main scanning, while moving the full-line head and the recording paper relatively to each other. The direction in which sub-scanning is performed is called the sub-scanning direction. Consequently, the conveyance direction of the recording paper is the sub-scanning direction and the direction perpendicular to it is called the main scanning direction.

Moreover, although the configuration with the KCMY four standard colors is described in the present embodiment, combinations of the ink colors and the number of colors are not limited to those. Light inks and dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device or an alarm sound generator) for warning when the remaining amount of any ink is low, and has a mechanism for preventing loading errors among the colors.

The print determination unit 24 has an image sensor (line sensor or the like) for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern or the target image printed by the print heads 12K, 12C, 12M, and 12Y of the respective colors, and performs ejection determination for each head. The ejection determination includes detection of the ejection, measurement of the dot size, and measurement of the dot formation position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substances that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly before the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in the Figures, the paper output unit 26A for the target prints is provided with a sorter for collecting prints according to print orders.

Figure 3A:
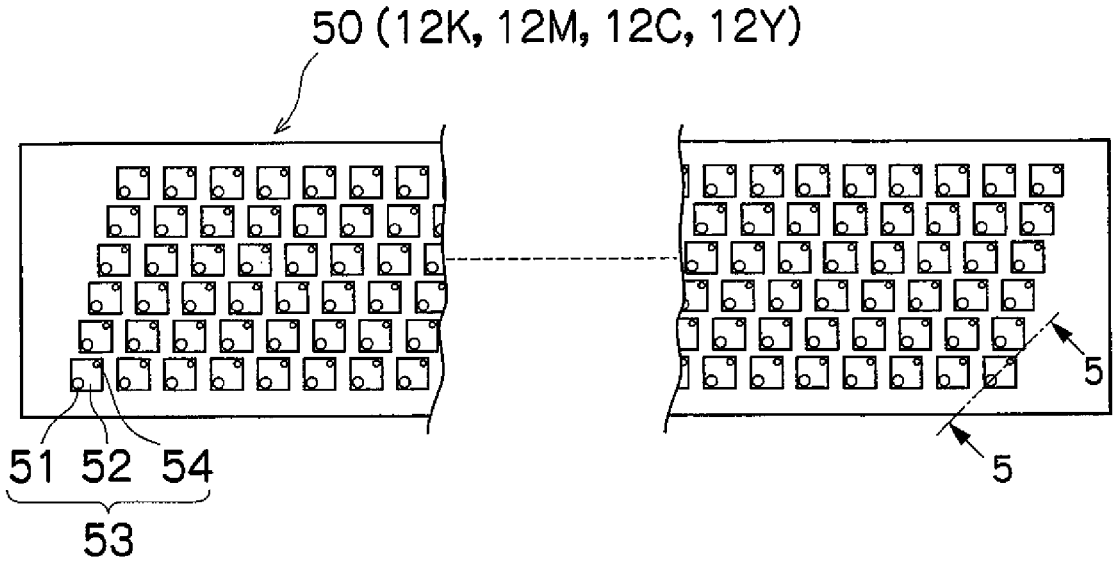
FIG. 3A is a plan perspective diagram showing an example of the structure of a head.

Next, the print head will be described. The print heads 12K, 12C, 12M and 12Y of the respective ink colors have the same structure, and a reference numeral 50 is hereinafter designated to any of the print heads. In FIG. 3A, a perspective plan view showing the head 50 according to an embodiment of the present invention is provided.

Figure 3B:
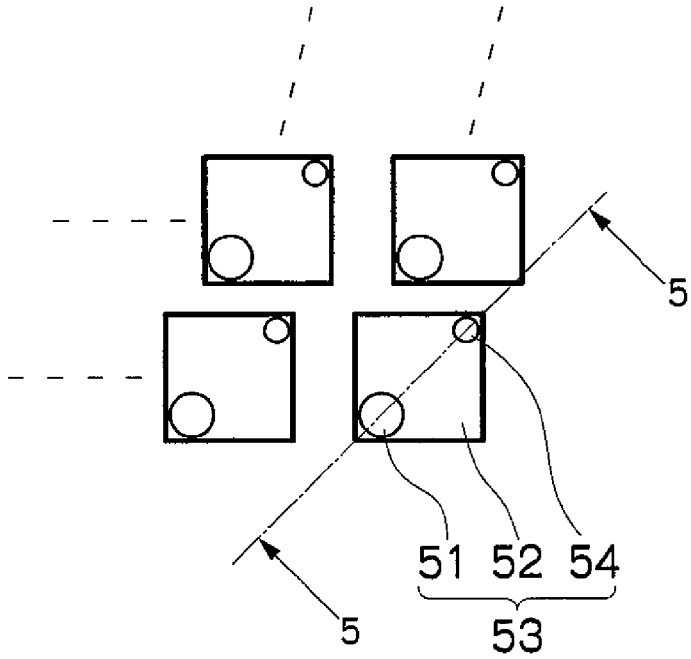
FIG. 3B is a partial enlarged diagram of same.
Figure 4:
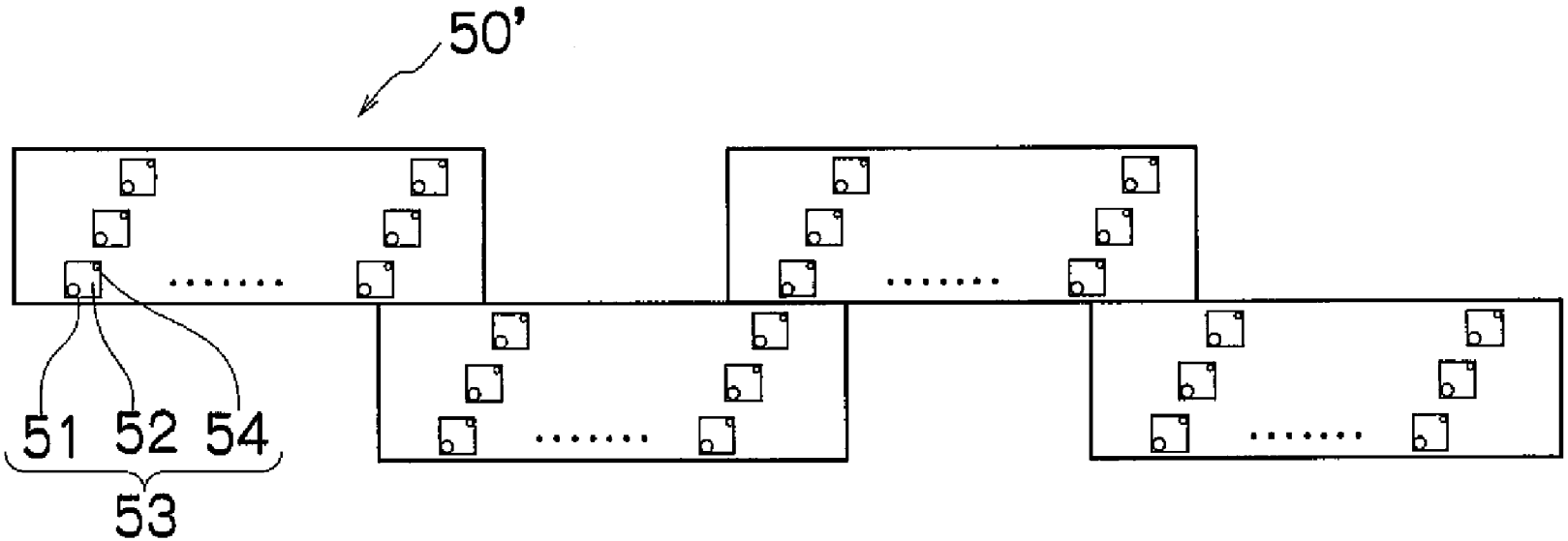
FIG. 4 is a plan perspective diagram showing a further example of the structure of a head.
Figure 5:
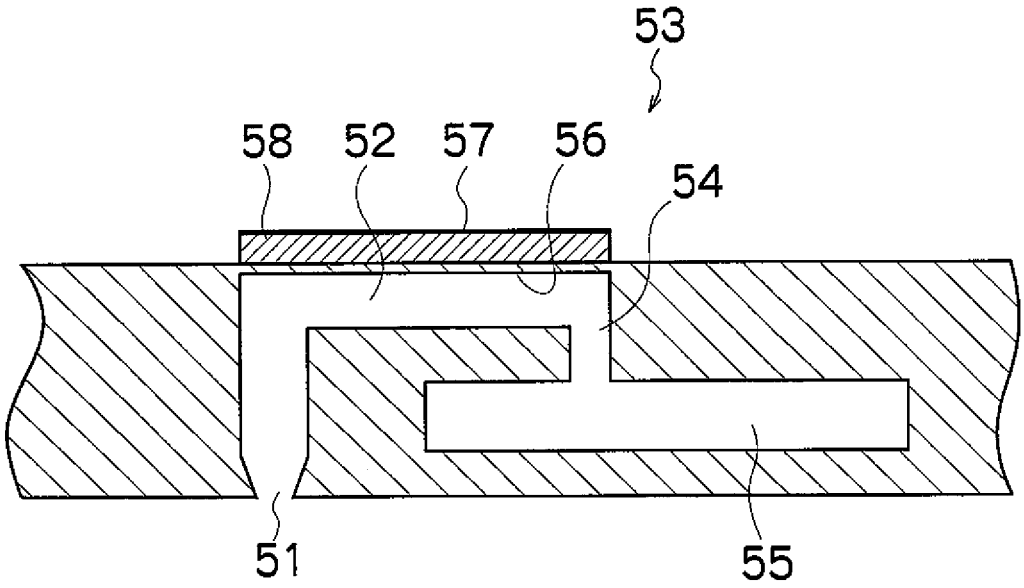
FIG. 5 is a cross-sectional diagram along line 5-5 in FIGS. 3A and 3B.

FIG. 3A is a perspective plan view showing an example of the configuration of the head 50, FIG. 3B is an enlarged view of a portion thereof, FIG. 4 is a perspective plan view showing another example of the configuration of the head, and FIG. 5 is a cross-sectional view taken along the line 5-5 in FIGS. 3A and 3B, showing the inner structure of a droplet ejection element (an ink chamber unit for one nozzle 51).

The nozzle pitch in the head 50 should be minimized in order to maximize the density of the dots printed on the surface of the recording paper 16. As shown in FIGS. 3A and 3B, the head 50 according to the present embodiment has a structure in which a plurality of ink chamber units (droplet ejection elements) 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the recording paper 16 in a direction substantially perpendicular to the conveyance direction of the recording paper 16 is not limited to the example described above. For example, instead of the configuration in FIG. 3A, as shown in FIG. 4, a line head having nozzle rows of a length corresponding to the entire width of the recording paper 16 can be formed by arranging and combining, in a staggered matrix, short head units 50' having a plurality of nozzles 51 arrayed in a two-dimensional fashion.

As shown in FIGS. 3A and 3B, the planar shape of the pressure chamber 52 provided for each nozzle 51 is substantially a square, and an outlet to the nozzle 51 and an inlet of supplied ink (supply port) 54 are disposed in both corners on a diagonal line of the square. The shape of the pressure chamber 52 is not limited to that of the present example and various modes are possible in which the planar shape is a quadrilateral shape (diamond shape, rectangular shape, or the like), a pentagonal shape, a hexagonal shape, or other polygonal shape, or a circular shape, elliptical shape, or the like.

As shown in FIG. 5, each pressure chamber 52 is connected to a common channel 55 through the supply port 54. The common channel 55 is connected to an ink tank (not shown in FIG. 5), which is a base tank that supplies ink, and the ink supplied from the ink tank is delivered through the common flow channel 55 in FIG. 5 to the pressure chambers 52.

Actuators 58 each provided with an individual electrode 57 are bonded to a pressure plate 56 (a diaphragm) which forms the ceiling of one portion (in FIG. 5, the ceiling) of the pressure chambers 52. When a drive voltage is applied to the individual electrode 57, the actuator 58 is deformed, the volume of the pressure chamber 52 is thereby changed, and the pressure in the pressure chamber 52 is thereby changed, so that the ink inside the pressure chamber 52 is thus ejected through the nozzle 51. The actuator 58 is preferably a piezoelectric element. When ink is ejected, new ink is supplied to the pressure chamber 52 from the common flow channel 55 through the supply port 54.

Figure 6:
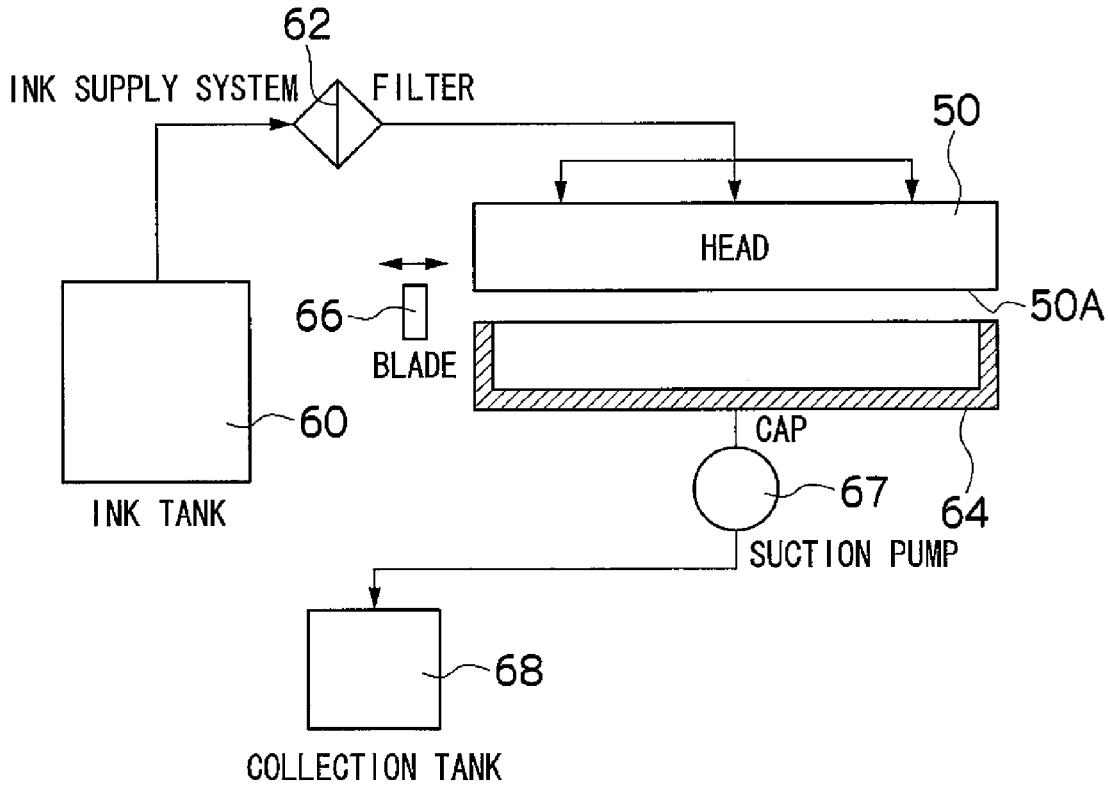
FIG. 6 is a schematic drawing showing the composition of an ink supply system in the inkjet recording apparatus according to an embodiment of the present invention.

FIG. 6 is a schematic drawing showing the configuration of the ink supply system in the inkjet recording apparatus 10. The ink tank 60 is a base tank that supplies ink to the print head 50 and is set in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 6 is equivalent to the ink storing and loading unit 14 in FIG. 1 described above.

A filter 62 for removing foreign matters and bubbles is disposed in the middle of the channel connecting the ink tank 60 and the print head 50 as shown in FIG. 6. The filter mesh size of the print head 50 is preferably equivalent to or less than the diameter of the nozzle and commonly about 20 μm.

Although not shown in FIG. 6, it is preferable to provide a sub-tank integrally to the print head 50 and nearby the print head 50. The sub-tank has a damper function for preventing variation in the internal pressure of the head and a function for improving refilling of the print head.

The inkjet recording apparatus 10 is also provided with a cap 64 as a device to prevent the nozzles from drying out and to prevent an increase in the ink viscosity in the vicinity of the nozzles, and a wiper blade (cleaning blade) 66 constituting a cleaning device for the nozzle face 50A.

A maintenance unit comprising the cap 64 and the wiper blade 66 is arranged outside the conveyance path of the recording medium 16, and the print head 50 is moved to a wiping position by a head movement device, which is not shown in the drawings. Alternatively, the maintenance unit may be designed to be movable with respect to the print head 50, in such a manner that the maintenance unit is moved to a maintenance position below the print head 50 from a prescribed withdrawn position, as and when necessary.

The cap 64 is displaced up and down relatively with respect to the print head 50 by an elevator mechanism (not shown). When the power of the inkjet recording apparatus 10 is turned OFF or when the apparatus is in a standby state for printing, the elevator mechanism raises the cap 64 to a predetermined elevated position so as to come into close contact with the print head 50, and the nozzle region of the nozzle surface 50A is thereby covered by the cap 64.

The wiper blade 66 is composed by an elastic member such as rubber, a porous body or resin, and can slide in the recording medium conveyance direction on the ink ejection surface (nozzle surface 50A) of the print head 50 by means of a blade movement device There are no particular restrictions on the blade movement device, but it is also suitable to use, for example, a ball screw conveyance device, a belt and pulley conveyance device, a rack and pinion conveyance device, or the like.

If there are ink droplets or foreign matter adhering to the nozzle surface 50A, then the nozzle surface 50A is wiped by causing the wiper blade 66 to slide over the nozzle surface 50A, thereby cleaning same. A plurality of wiper blades 66 provided respectively for the print heads 50 of the respective colors (12K, 12C, 12M, 12Y) may be moved in a unified fashion, or they each may be used individually.

The inkjet recording apparatus 10 forming the liquid droplet ejection apparatus relating to an embodiment of the present invention comprises a device which judges the replacement timing of the wiper blade 66 by determining the edge shape of the front tip section of the wiping blade 66 constituting a cleaning apparatus, which makes contact with the nozzle surface 50A, and this device is described in further detail hereinafter.

During printing or standby, when the frequency of use of specific nozzles 51 is reduced and ink viscosity increases in the vicinity of the nozzles 51, a preliminary discharge is made toward the cap 64 to eject the ink degraded due to the increase in viscosity.

Also, when bubbles have become intermixed in the ink inside the print head 50 (the ink inside the pressure chamber 52), the cap 64 is placed on the print head 50, the ink inside the pressure chamber 52 (the ink in which bubbles have become intermixed) is removed by suction with a suction pump 67, and the suction-removed ink is sent to a collection tank 68. This suction action is carried out when ink is initially loaded into the head and when service has started after a long period of being stopped, and entails the suctioning and removing of degraded ink whose viscosity has increased (hardened).

More specifically, when a state in which ink is not ejected from the print head 50 continues for a certain amount of time or longer, the ink solvent in the vicinity of the nozzles 51 evaporates and ink viscosity increases. In such a state, ink can no longer be ejected from the nozzles 51 even if the pressure generating devices (piezoelectric elements) for the ejection driving is operated. Before reaching such a state (in a viscosity range that allows ejection by the operation of the pressure generating device), the pressure generating devices are operated to perform the preliminary discharge to eject the ink whose viscosity has increased in the vicinity of the nozzles toward the ink receptor. After the nozzle surface 50A is cleaned by a wiping member such as the wiper blade 66 provided as a device constituting a cleaning device for the nozzle surface 50A, the preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed inside the nozzle 51 or the pressure chamber 52, or when the ink viscosity inside the nozzle 51 has increased over a certain level, ink can no longer be ejected by the preliminary discharge, and a suctioning action is carried out as described above.

More specifically, when bubbles have become intermixed in the ink inside the nozzle 51 or the pressure chamber 52, ink can no longer be ejected from the nozzle 51 even if the pressure generating device is operated. Also, when the ink viscosity inside the nozzle 51 has increased over a certain level, ink can no longer be ejected from the nozzle 51 even if the pressure generating device is operated. In these cases, with the cap 64 being placed on the nozzle surface 50A of the print head 50, operation is performed to suction the ink in which bubbles have become intermixed or the ink whose viscosity has increased inside the pressure chamber 52 with the suction pump 67.

However, since this suction action is performed with respect to all the ink in the pressure chambers 52, the amount of ink consumption is considerable. Therefore, a preferred aspect is one in which a preliminary discharge is performed when the increase in the viscosity of the ink is small. The cap 64 illustrated in FIG. 6 functions as a suctioning device and it can also function as an ink receptacle for preliminary ejection.

Moreover, desirably, the inside of the cap 64 is divided by means of partitions into a plurality of areas corresponding to the nozzle rows, thereby achieving a composition in which suction can be performed selectively in each of the demarcated areas, by means of selectors, or the like.

Next, the device which determines the state of the edge of the wiping portion of the wiper blade 66 constituting the cleaning apparatus of the print head 50 and which judges the replacement timing of the wiper blade 66 will be described in more detail.

FIGS. 7A to 7D show states of determining the edge shape of the front tip section of the wiper blade 66 which constitutes the cleaning apparatus of the print head 50.

As shown in FIGS. 7A to 7D, the wiper blade 66 comprises a wiping section 66*a* which wipes the nozzle surface 50A of the print head 50, and a supporting section 66*b* which supports the wiping section 66*a* and moves along the nozzle surface 50A. The wiping section 66*a* is made of an elastic member, such as HNBR, silicone, EPDM, or the like.

Furthermore, a determination plate 70 is disposed on the outer side of one end portion of the print head 50, so as to form substantially the same plane as the nozzle surface 50A, in the direction of extension of the nozzle surface 50A. The determination plate 70 functions as a device onto which ink adhering to the wiping section 66*a* of the wiper blade 66 is deposited by causing the wiping section 66*a* to make contact with the determination plate 70, and thereby the edge shape of the wiping section 66*a* is transferred to the determination plate 70.

Furthermore, there are also provided: a line CCD 72 which captures an image of the trace of ink (edge shape trace) which has adhered to the surface of the determination plate 70; an image processing unit 73 which analyzes the image of the ink trace (edge trace) read in by the line CCD 72 to determine the edge shape of the wiping member (wiping section 66*a*); and a judgment unit 75 which judges the replacement timing of the wiping member on the basis of the determined edge shape.

Figure 7A:
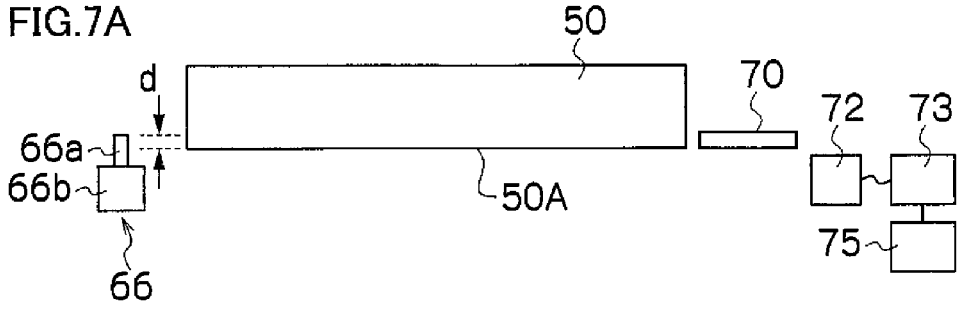
FIGS. 7A to 7D are illustrative diagrams showing an aspect of determining the edge shape of the front tip of the wiping section of a wiper blade which constitutes a cleaning apparatus.

As shown in FIG. 7A, the front tip portion of the wiping section 66*a* of the wiper blade 66 projects out by a length "d" beyond the nozzle surface 50A of the print head 50.

Figure 7B:
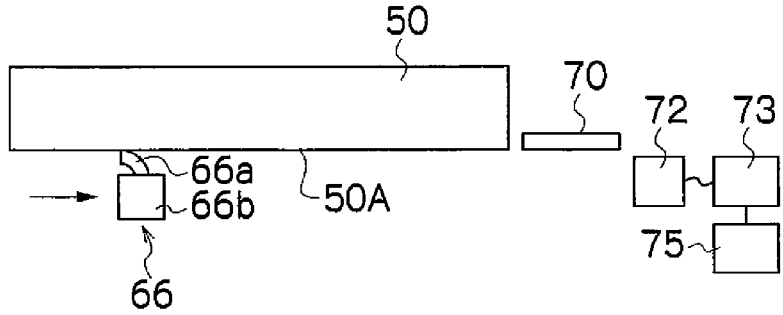

Thereby, as shown in FIG. 7B, when the supporting section 66*b* is moved along the nozzle surface 50A as indicated by the arrow, then the front tip portion of the wiping section 66*a* slides on and wipes the nozzle surface 50A. The amount of overlap, d, between the wiping section 66*a* and the print head 50 is also called the amount of contact or the amount of overlap. This value d may be, for example, 1 to 2 μmm. By wiping the nozzle surface 50A with the wiping section 66*a* in this way, the ink on the nozzle surface 50A becomes attached to the front tip portion of the wiping section 66*a*.

Figure 7C:
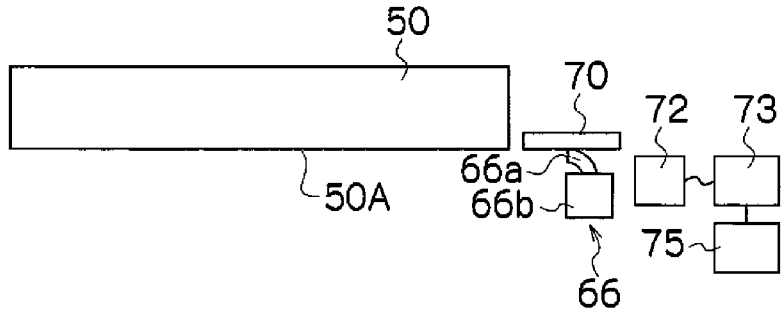

Next, as shown in FIG. 7C, after the wiping section 66*a* of the wiper blade 66 has wiped over the nozzle surface 50A of the print head 50, the wiper blade 66 then is moved so that the wiping section 66*a* wipes, in a continuous fashion, over the determination plate 70 forming substantially the same flat surface as the nozzle surface 50A, and is then halted in a substantially central portion of the determination plate 70. In this case, since the ink on the nozzle surface 50A has adhered to the front tip portion of the wiping section 66*a*, then a trace (contact trace) formed by the contact of the wiping section 66*a* is transferred to the surface of the determination plate 70. By this means, the edge shape of the wiping section 66*a* is transferred to the determination plate 70.

Figure 7D:
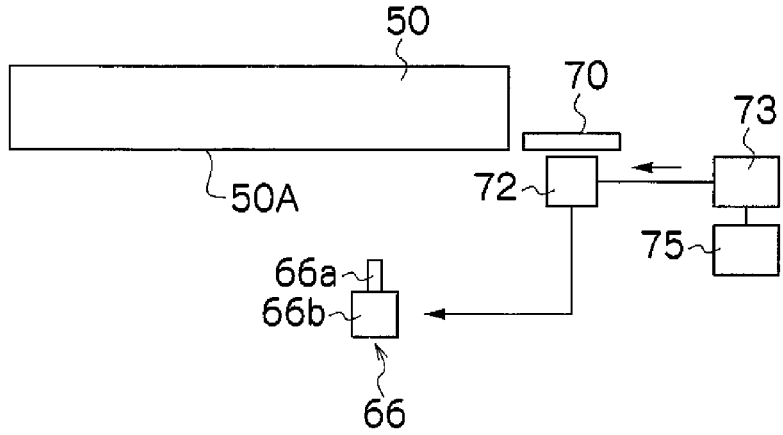

Thereupon, as shown in FIG. 7D, the wiper blade 66 is moved downwards in such a manner that the wiping section 66*a* is separated from the determination plate 70, and then waits at a standby position. On the other hand, the line CCD 72 is moved to a position beneath the determination plate 70 and captures an image of the edge trace transferred to the surface of the determination plate 70 due to the contact of the wiping section 66*a* of the wiper blade 66.

The image of the edge trace on the surface of the determination plate 70 which is captured by the line CCD 72 is sent to the image processing unit 73, where it is subjected to image analysis, and the edge shape of the front tip portion of the wiping section 66*a* is determined accordingly. Thereupon, in the judgment unit 75, the replacement timing of the wiping member is judged on the basis of the determined edge shape.

In order to determine the shape of the wiping section 66*a* from the edge trace (contact trace) of the front tip portion of the wiping section 66*a* left on the surface of the determination plate 70 in this way, it is suitable to use a determination plate 70 which has a high contrast with respect to the color of the ink being determined, so that the edge trace can be determined readily. For example, when determining black ink, it is desirable to use a white determination plate.

Furthermore, the material of the determination plate 70 may be an absorbing body which absorbs the ink, or it may be a non-absorbing body which does not absorb ink. When using a determination plate which is non-absorbent, the surface energy of the determination plate 70 is desirably set to a low energy, in order to allow ink to deposit thereon easily. Alternatively, it is also effective to provide small indentations in the surface of the determination plate 70. In the case of a determination plate 70 which is not absorbent, after the determination process, the ink trace adhering to the determination plate 70 may be wiped away with the wiper blade 66.

On the other hand, in the case of an absorbing body being used as the determination plate 70, particles or something coated with particles which speed up the absorption of the ink in the direction perpendicular to the determination surface may be attached to the determination plate 70 so that the adhering ink tends to be absorbed into the determination plate 70 before spreading in the horizontal direction of the determination surface. For example, a so-called glossy inkjet paper may be attached to the determination plate. In these cases, accurate measurement of the edge shape of the wiping section 66*a* is possible. In the case of an absorbent body being used as the determination plate 70, when the edge shape of the wiping section 66*a* is to be determined again, the absorbent paper, or the like, attached to the surface of the determination plate 70 is replaced.

Figure 8A:
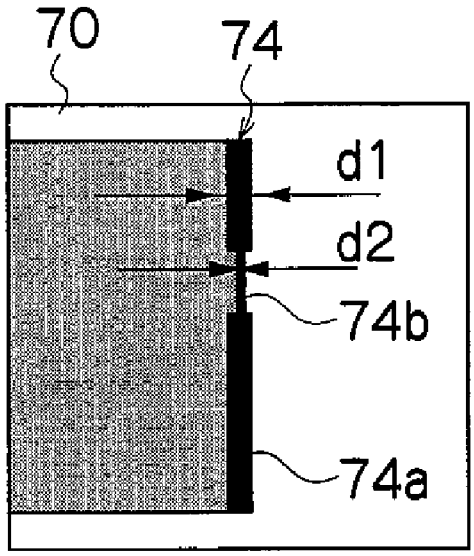
FIGS. 8A and 8B are illustrative diagrams each showing an ink trace of the front tip portion of a wiping section which has been transferred onto a determination plate.
Figure 8B:
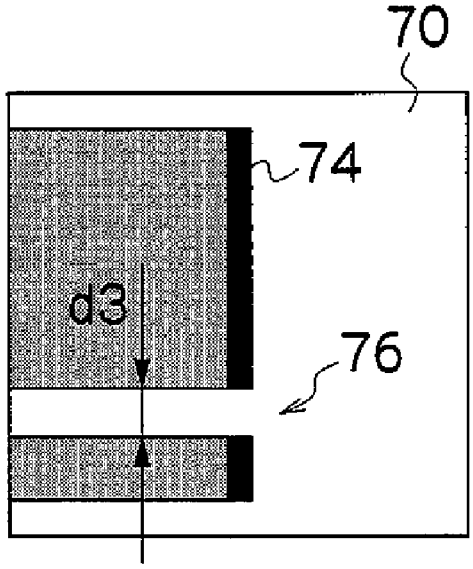

FIGS. 8A and 8B show ink traces (contact traces) of the front tip portion of the wiping section 66*a* which are left on the determination plate 70.

As described above, since the wiping section 66*a* is made to wipe over the surface of the determination plate 70 and is then halted in substantially the central portion of the determination plate 70, then as shown in FIGS. 8A and 8B, a straight line-shaped dark ink trace 74 which indicates the halting of the wiping section 66*a* is formed as an edge trace in substantially the central portion of the determination plate 70. FIGS. 8A and 8B show states where the trace created by the wiping section 66*a* rubbing over the surface of the determination plate 70 is formed thinly, to the left-hand side of the straight line-shaped ink trace 74; if the determination plate 70 is an absorbing body, then a wiping trace is left in this way, whereas if the determination plate 70 is a non-absorbing body, then a wiping trace of this kind is not left.

In the example shown in FIG. 8A, the ink trace 74 has a large-width portion 74*a* and a narrow-width portion 74*b*. The narrow-width portion 74*b* is considered to indicate wearing of the front tip portion of the wiping section 66*a*. By analyzing the image of the surface of the determination plate 70 which has been captured by the line CCD 72, the width d1 of the large-width portion 74*a* and the width d2 of the narrow-width portion 74*b* of the ink trace 74 are determined. Furthermore, in the example shown in FIG. 8B, a portion of the ink trace 74 is missing. In this case, the length d3 of this missing portion (omitted portion) 76 is determined by image analysis.

By analyzing the image of the surface of the determination plate 70 captured by the line CCD 72, in the image processing unit 73 in this way, the maximum width and minimum width of the ink trace 74, the presence or absence of an omitted portion, and the length of the omitted portion are determined. On the basis of the determined values, the judgment unit 75 determines the wear of the front tip portion of the wiping section 66*a* of the wiper blade 66 and accordingly determines the requirement for replacement of the wiper blade 66 (wiping section 66*a*) and the replacement timing.

In this way, in the present embodiment, the edge shape of the front tip portion of the wiping section 66*a* of the wiper blade 66 is determined by means of the determination plate 70 onto which the ink can be transferred by placing the front tip portion of the wiping section 66*a* of the wiper blade 66 in contact with the determination plate 70, the line CCD 72 which captures an image of ink trace 74 transferred to the determination plate 70, and the image processing unit 73 and the judgment unit 75 which analyze the images that have been read in.

As described above, a composition which determines the edge shape of the front tip portion of the wiping section 66*a* indirectly, by determining the ink trace 74 created by placing the front tip portion of the wiping section 66*a* in contact with the determination plate 70, is adopted. This is because, in the case of a method which determines the edge shape by capturing an image of the front tip portion of the wiping section 66*a* directly by means of an imaging apparatus, sufficient contrast between the worn portions of the front tip portion of the wiping section 66*a* and the unworn portions cannot be obtained, and therefore the imaging apparatus increases in size, the cost of the apparatus rises, and in order to capture a three-dimensional shape directly, the data volume becomes larger, greater time is required, efficiency becomes poorer, and furthermore, a corresponding storage capacity is also required.

Therefore, in the present embodiment, by transferring the edge trace (ink trace 74) of the front tip portion of the wiping section 66*a* once to the determination plate 70 as described above, the three-dimensional information is converted into two-dimensional information, and therefore the volume of information is reduced. Furthermore, during this transfer process, by using an application liquid having a high contrast with respect to the determination plate 70 (in the present embodiment, by using ink), as the liquid which is transferred from the front tip portion of the wiping section 66*a* to the determination plate 70, then the edge shape is made prominent and can be read in accordingly.

Figure 9:
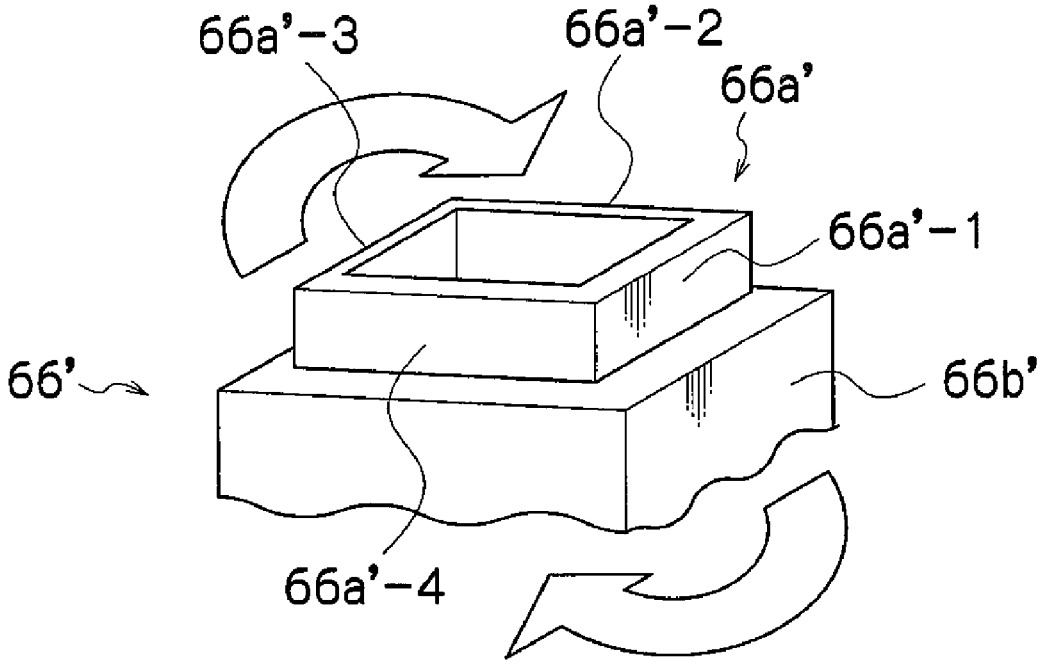
FIG. 9 is an oblique diagram showing a further example of a wiper blade.

FIG. 9 is a further example of a wiper blade. The wiping section 66*a*' of the wiper blade 66' shown in FIG. 9 has a quadrilateral cylindrical shape in which the interior of a square-shaped bar is removed, and it comprises four wiping sections 66*a*'-1, 66*a*'-2, 66*a*'-3 and 66*a*'-4. Furthermore, the supporting section 66*b*' to which the wiping sections 66*a*' are fixed is rotatable as indicated by the arrows in FIG. 9, by means of a rotating mechanism which is not shown in FIG. 9.

Since the wiping operation in the present embodiment is performed only in one direction, as indicated in FIGS. 7A to 7D, then if wiping has just been carried out by using wiping section 66*a*'-1, and if the wiping section 66*a*'-1 is found to be worn, the supporting section 66*b*' is rotated through 90° in the direction of the arrows in FIG. 9, and wiping is subsequently carried out by using the wiping section 66*a*'-2. Consequently, the four side portions of the wiper blade 66' shown in FIG. 9 can be used as wiping members. Therefore, it is possible to reduce the replacement frequency of the wiping section 66*a*', accordingly.

In the example shown in FIG. 9, there are four wiping faces, and hence the replacement frequency of the wiping member can be reduced to ¼, compared to a case where there is one wiping face as shown in FIGS. 7A to 7D. Furthermore, apart from a wiping member formed by removing a square bar shape, it is also possible to use a wiping member having three wiping faces formed by removing a triangular bar shape, or conversely, to provide a greater number of wiping faces. Moreover, it is desirable that the wiping width of one wiping face is greater than the wiping width of the print head 50, since this makes it possible to complete wiping of the nozzle surface by means of one wiping action.

Furthermore, if using the side faces of a tube-shaped wiping member created by removing the interior of a square bar shape as the wiping surfaces in this way, a structure is obtained in which both ends of the wiping face are held by the end portions of other wiping faces, and therefore deformation, such as warping or bending at the end portions of the wiping face, is not liable to occur. Consequently, in the case of a method which transfers the shape of the front tip portion of the wiping section onto a determination plate and then determines the edge trace thereof as per the present embodiment, a merit is obtained in that the effects on the determination process which the shape of the end portion of the wiping section causes can be reduced.

Moreover, not only is it possible to lengthen the replacement timing by reducing the replacement frequency of the wiping member by being able to use the four side portions of the wiping section as the wiping surfaces, but also a structure is obtained in which both ends of the wiping surface are held by the end portions of other wiping surfaces, and therefore resistance to deterioration is enhanced, and the replacement timing can be increased yet further Furthermore, since a structure is achieved in which both ends of the wiping surface are held, then compared to the wiping member in which both the ends are not held as shown in FIGS. 7A to 7D, it is possible to apply a more uniform wiping pressure over the whole of the nozzle surface of the print head, and therefore a merit is also obtained in that wiping non-uniformities are not liable to arise.

Figure 10:
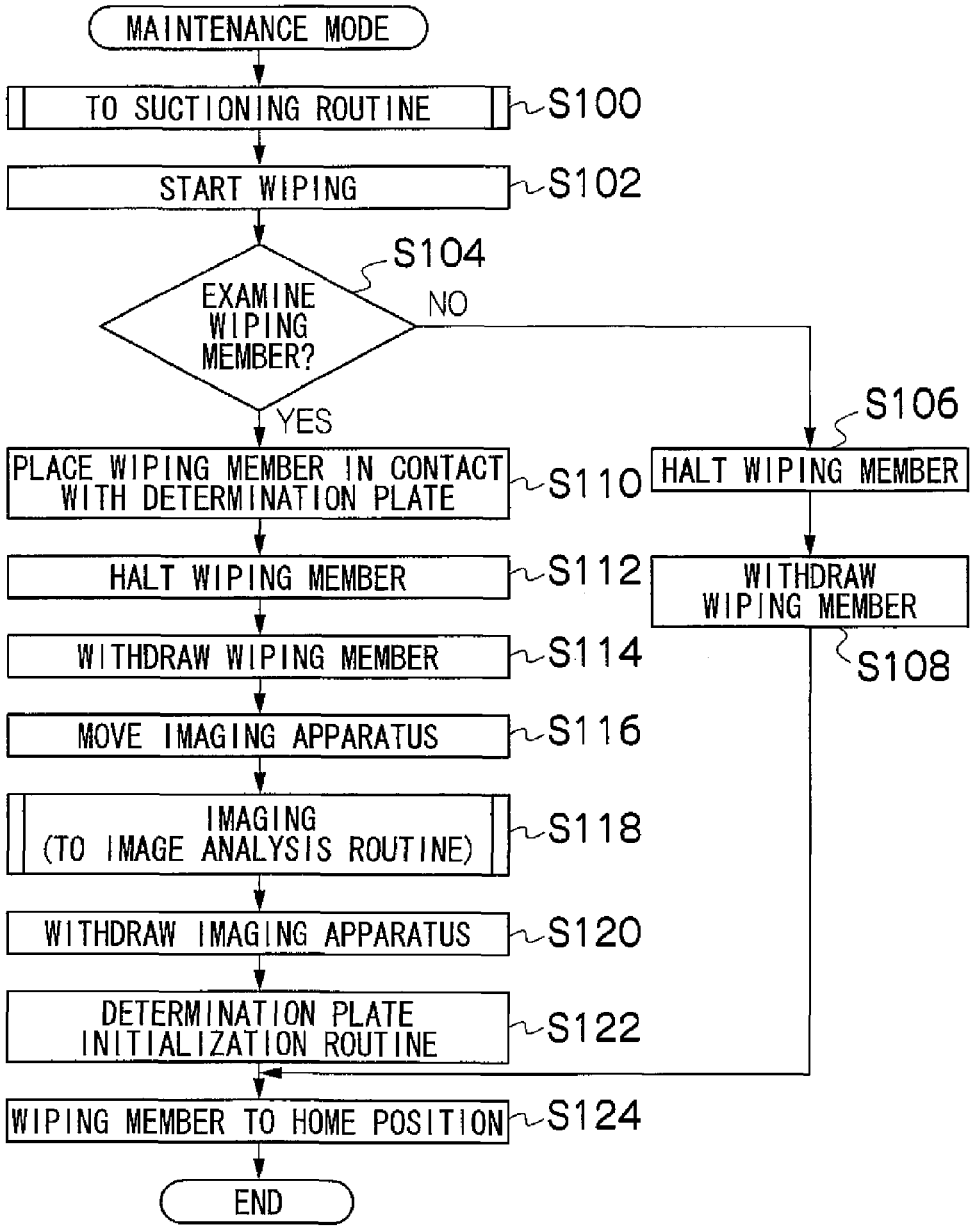
FIG. 10 is a flowchart showing a method of determining the edge shape of a wiping section of a wiper blade and judging the replacement timing.

There follows a description of a method of determining the edge shape of the wiping section 66*a* of the wiper blade 66 and judging the replacement timing of the wiping member, by following the flowchart in FIG. 10.

When the inkjet recording apparatus 10 is transferred to maintenance mode) firstly, at step S100 in FIG. 10, a suctioning routine is executed for performing a suctioning operation in order to forcibly remove the degraded ink from inside the print head 50.

Figure 11:
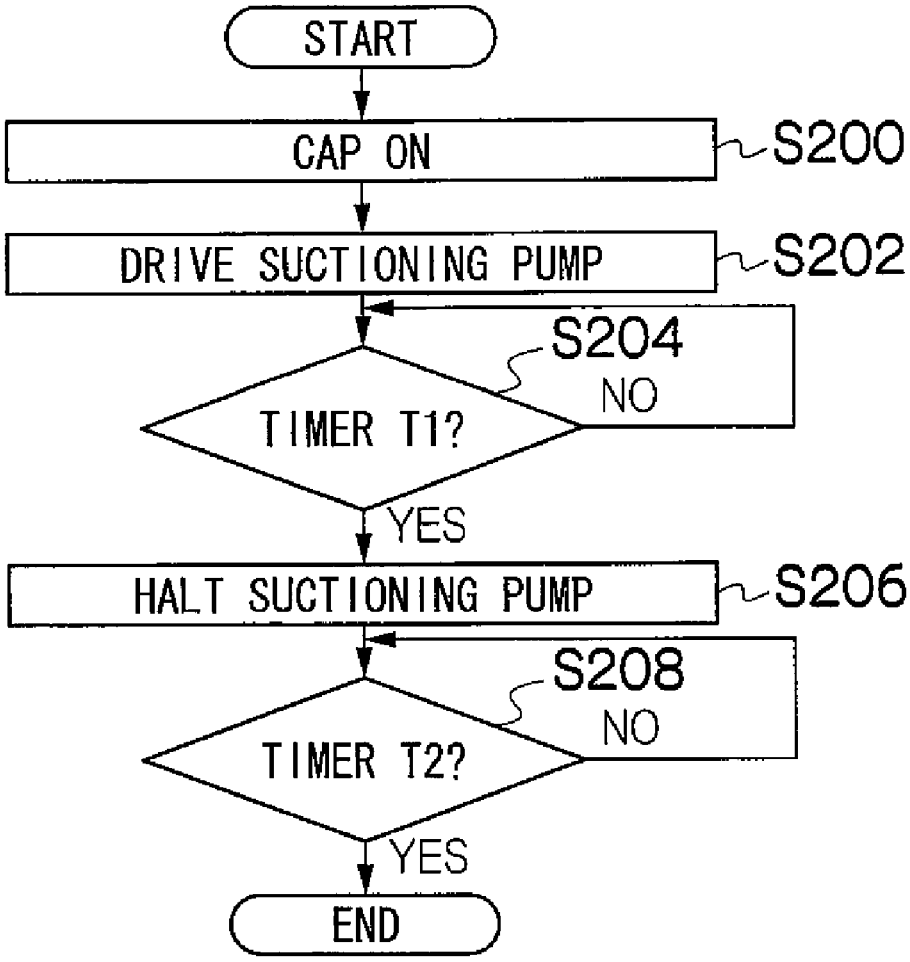
FIG. 11 is a flowchart showing processing of a suctioning routine.

FIG. 11 shows the suctioning routine.

As shown in FIG. 11, in the suctioning routine, firstly, at step S200, the nozzle surface is capped. In other words, the cap 64 is placed in tight contact with the print head 50, so that the nozzle region on the nozzle surface 50A is covered with this cap 64.

Thereupon, at step S202, with the cap 64 still placed in tight contact with the print head 50, the suction pump 67 is driven and the interior of the cap is reduced to a negative pressure. The driving time of the suction pump 67 is managed by a timer T1. At step S204, it is judged whether or not the drive time has reached T1, the suction pump 67 is driven until the drive time has reached T1, and after time T1 has elapsed, the driving of the suction pump 67 is halted, at step S206. By this means, the ink inside the print head 50 is suctioned, and ink becomes attached to the nozzle surface 50A.

During suctioning, the back pressure of ink inside the print head 50 can be increased. By increasing the back pressure in this way in order to assist the suctioning force of the suction pump 67, then it is possible to lower the capacity of the suction pump 67.

After halting the driving of the suction pump 67, this state is maintained without change until timer reaches time T2. The time period specified by the time T2 is a time period for causing the material adhering to the nozzle surface 50A to dissolve. Consequently, the adhering material on the nozzle surface 50A is dissolved or separated reliably, and the subsequent wiping characteristics of the wiper blade 66 are improved.

In step S208, after halting the suction pump 67, it is judged whether or not the time T2 has elapsed, and when the time T2 has elapsed, the suctioning routine ends, and the procedure returns to the main sequence shown in FIG. 10.

Thereupon, at step S102 in FIG. 10, the wiping action of the nozzle surface 50A by the wiper blade 66 is started.

More specifically, as shown in FIG. 7A, the wiper blade 66 is moved from a standby position (withdrawn position) to a position where the front tip portion of the wiping section 66*a* makes contact with the nozzle surface 50A of the print head 50. In this case, as shown in FIG. 7A, the amount of overlap between the front tip portion of the wiping section 66*a* and the nozzle surface 50A (the contact amount or the overlap amount) is 1 to 2 mm.

The nozzle surface 50A is sufficiently wetted by the adherence of ink due to the suctioning in step S100. This ink adhering to the nozzle surface 50A is wiped so as to be swept away by the wiping section 66*a* of the wiper blade 66.

Next, at step S104, it is judged whether or not to examine the wiping member. There are no particular restrictions on the timing of examining the wiping member, and this timing may be set, for example, to a timing after each set number of wiping actions, a timing specified by the user, a reset operation when a jam or the like has occurred, or a restoring operation after a long period out of use. The judgment of whether or not to examine the wiping member may be made before the maintenance sequence.

If it is judged at step S104 that the examination of the wiping member is not carried out, then at step S106, the wiping member 66*a* is halted at a position where it has wiped the nozzle surface 50A until the end portion of the print head 50, and at step S108, the wiper blade 66 is withdrawn, the procedure advances to step S124, and the wiper blade 66 is moved to the home position and subsequently waits in this position.

On the other hand, if it is judged at step S104 that the wiping member is to be examined, then at step S110, the wiper blade 66 which has wiped the nozzle surface 50A until the end portion of the print head 50 is moved until the determination plate 70, and the wiping section 66*a* is placed in contact with the surface of the determination plate 70, as shown in FIG. 7C.

At step S112, the wiper blade 66 is halted for a short time in a state where the wiping section 66*a* is in contact with the surface, in the vicinity of the central portion of the determination plate 70. By halting the front tip portion of the wiping section 66*a* while the wiping section 66*a* is in contact with the surface of the determination plate 70, the ink adhering to the wiping section 66*a* is transferred to the determination plate 70. It is possible to increase the amount of ink transferred by halting the front tip portion of the wiping section 66*a* for a short time while it is in contact with the surface of the determination plate 70 as described above, and hence the determined edge traced can be made clearer.

Next, at step S114, the wiping section 66*a* is separated from the surface of the determination plate 70, and the wiper blade 66 is moved to a standby position, as shown in FIG. 7D.

When the front tip portion of the wiping section 66*a* is placed in contact with the surface of the determination plate 70 and the edge trace thereof is transferred to the determination plate 70 in this way, then if the surface of the determination plate 70 is positioned in the plane of extension of the nozzle surface 50A in such a manner that the surface of the determination plate 70 is in substantially the same plane as the nozzle surface 50A as shown in FIGS. 7A to 7D, it is possible to wipe the surface of the determination plate 70 continuously after wiping the nozzle surface 50A, and the wiping section 66*a* can be brought into contact with the surface of the determination plate 70 without a new motion of the wiper blade 66.

Moreover, by disposing a determination plate 70 at a position which is higher than the nozzle surface 50A by a distance that is smaller than the amount of overlap (amount of contact) between the wiping section 66*a* and the nozzle surface 50A (for example, in the case of the amount of overlap is 2 mm, the determination plate 70 can be positioned 1 mm higher than the nozzle surface 50A), then when the front tip portion of the wiping section 66*a* becomes worn, it becomes less liable to strike the surface of the determination plate 70 and hence the edge shape of the front tip portion can be examined more rigorously.

In this case, rather than fixing the installation position of the determination plate 70, it is also possible to provide a mechanism which moves the determination plate 70 upward and downward. When the installation position of the determination plate 70 is raised, then it is possible to determine the edge under stricter conditions. Furthermore, if determination at a plurality of height positions is used in combination, then it is possible to determine the edge with a high degree of accuracy. Moreover, it is also possible to calculate the remaining number until reaching the threshold value at which replacement of the wiping member is judged to be necessary, in other words, the remaining number of wiping actions or the approximate remaining number of sheets until replacing the wiping member.

Next, at step S116, as shown in FIG. 7D, the imaging unit constituted by the line CCD 72 is moved to the lower side of the determination plate 70. At step S118, the image analysis routine is executed in order to capture an image of the edge trace of the wiping section 66*a* transferred to the surface by scanning the determination plate 70 by means of the imaging unit, determining the edge shape from the captured image, and judging the replacement of the wiping member accordingly.

Figure 12:
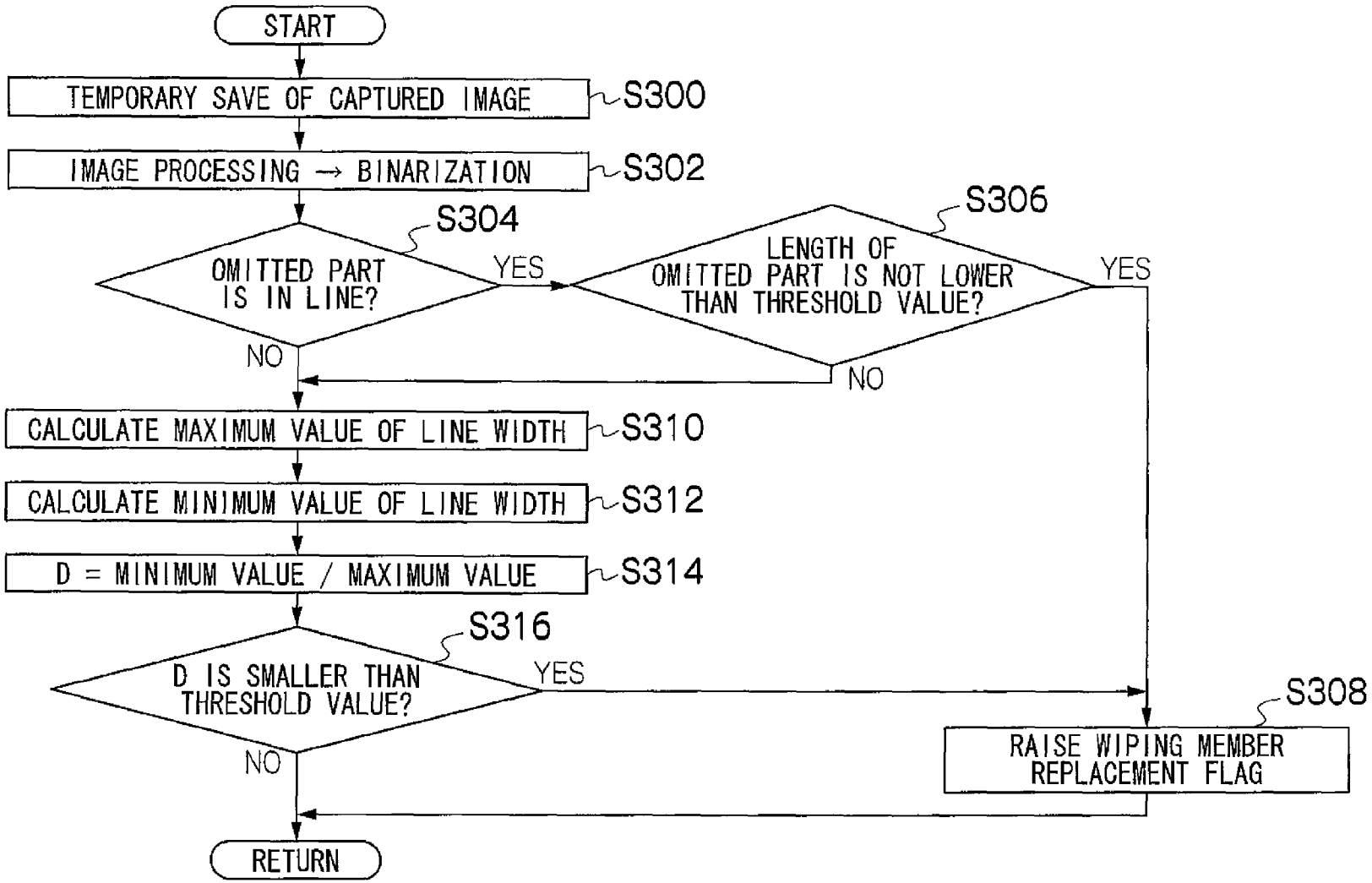
FIG. 12 is a flowchart showing processing of an image analyzing routine.

FIG. 12 shows an image analysis routine.

Firstly, at step S300 in FIG. 12, the image of the edge trace on the surface of the determination plate 70 captured by the line CCD 72 is saved in a memory (temporary storage of captured image).

Next, at step S302, the image processing unit 73 normalizes the values of the respective pixels to one of two values, either 0 (white) or 1 (black), by comparing the density of the respective pixels in the temporarily stored image data with a prescribed reference value. As a result of this, the pixels are binarized. Furthermore, the image processing in the image processing unit 73 includes: finding the differential between a previously captured image of the determination plate 70 in a state where no ink has been transferred, and the currently captured image of the ink trace (edge trace); and performing brightness correction, outline correction, correction relating to the color of ink, image position correction, and the like. By calculating the number of pixels having a value 1 (black), using the binarized image of the edge trace (ink trace), the length of the omitted portions and the line widths are calculated as described later.

Next, at step S304, it is judged whether or not there is an omitted portion 76 in the line-shaped ink traces 74 such as those shown in FIG. 8B. If there is an omitted portion 76 in the line-shaped ink trace 74, then at step S306, the length of the omitted portion 76 is determined, and it is judged whether or not this value is equal to or greater than a threshold value. In the present embodiment, the threshold value used for judging an omitted portion is set to 1 mm. If the length of the omitted portion 76 is equal to or greater than this threshold value, then it is judged that replacement of the wiping member is necessary, and at step S308, a wiping member replacement flag is set and the image analysis routine is exited.

On the other hand, if there is no omitted portion 76 in the line-shaped ink trace 74 at step S304, or if there is an omitted portion 76 but the length of the omitted portion is smaller than the threshold value at step S306, then the procedure advances to the next step, S310, and processing for determining the line width is carried out.

In other words, firstly, at step S310, the maximum value d1 of the width (line width) of the line-shaped ink trace 74 such as that shown in FIG. 8A is calculated. Thereupon, at step S312, the minimum value d2 of the line width is calculated. In this case, the maximum value d1 and the minimum value d2 are determined by dividing the line-shaped ink trace 74 into a plurality of blocks in the lengthwise direction, determining the average width in each of these blocks, and finding the block having the largest average width and the block having the smallest average width. Desirably, the length of the divided blocks is smaller than the threshold value applied to the length of the omitted portions, but if it is too small, then it will take extra calculation time. In the present embodiment, the length of one divided block is set to 0.5 mm.

Next, at step S314, the judgment index D=(minimum value/maximum value) is calculated as the ratio between the minimum value and the maximum value of the edge width. At step S316, the judgment index D is compared with a threshold value (width threshold value). In the present embodiment, the width threshold value is set to 0.8. If the judgment index D is equal to or greater than the threshold value, then it is considered that replacement of the wiping member is not necessary, and the image analysis routine is then exited.

On the other hand, if the judgment index D is smaller than the threshold value, then it is judged that replacement of the wiping member is necessary, the procedure advances to step S308, the wiping member replacement flag is raised and the image analysis routine is exited.

As described above, in the present embodiment, the threshold value of the length or the omitted portion is 1 mm, and the width threshold value of the judgment index D is set to 0.8, but these threshold values depend on the material of the wiping member, the pressing force on the nozzle surface, the amount of overlap (amount of contact) between the wiping member and the print head (nozzle surface), the viscosity and surface tension of the ink, and the surface energy of the lyophobic film on the nozzle surface. Therefore, it is necessary to evaluate and determine these values in advance. In the present embodiment, a plurality of wiping members having different use frequencies are prepared, wiping actions are carried out under the same conditions, and in the case of the wiping non-uniformities being left by the wiping action, they are determined by determining the state of the edge.

After exiting the image analysis routine, the procedure returns again to the flowchart in FIG. 10, and at step S120, the line CCD 72 (imaging unit) is withdrawn. Thereupon, at step S122, the determination plate initialization routine is executed. In the determination plate initialization routine, the ink adhering to the determination plate 70 is removed, cleaning such as washing is carried out, and/or the plate is replaced according to requirements. Furthermore, a pre-scanning operation is carried out in advance in order to capture an image of the soiling, and the like, on the determination plate and to correct the image of the actual data accordingly. Moreover, if the determination plate is movable, then determining the initial position of the determination plate, and the like, should be performed. The wiping member for removing the ink, and the like, adhering to the determination plate may also be used as a wiping member which wipes the print head. In this case, desirably, the cleaning of the actual wiping member itself is carried out before the wiping of the determination plate.

Finally, at step S124, the wiping member is moved to a home position (standby position). Here, if the ink, and the like, attached to the wiping member is cleaned away, it is possible to prevent problems such as transfer errors, and the like, caused by ink of increased viscosity, in the next determination operation. Since the adherence of ink to the wiping member can be prevented in this way, then it is possible to extend the use frequency of the wiping member. Furthermore, the cleaning operation of the wiping member can be carried out in parallel with the cleaning of the determination plate, or alternatively, the cleaning of the wiping member may be carried out independently, before the cleaning of the determination plate.

When the sequence of operations described above has been completed, the maintenance mode ends.

Next, a second embodiment of the present invention will be described.

The determination of the edge of a wiping member according to the first embodiment described above uses a wiping operation of the wiping member, which involves moving a wiping member which has wiped a nozzle surface, directly, to a determination plate, and rubbing the wiping member against the determination plate in such a manner that the ink wiped away from the nozzle surface by the wiping member is deposited onto the determination plate. On the other hand, the determination of the edge of a wiping member according to the second embodiment involves depositing an application liquid which has been applied to the wiping member, onto the determination plate, rather than ink which has been wiped from the nozzle surface by the wiping member. Therefore, the edge shape determination device according to the present embodiment comprises a device of applying an application liquid to the wiping member.

Figure 13:
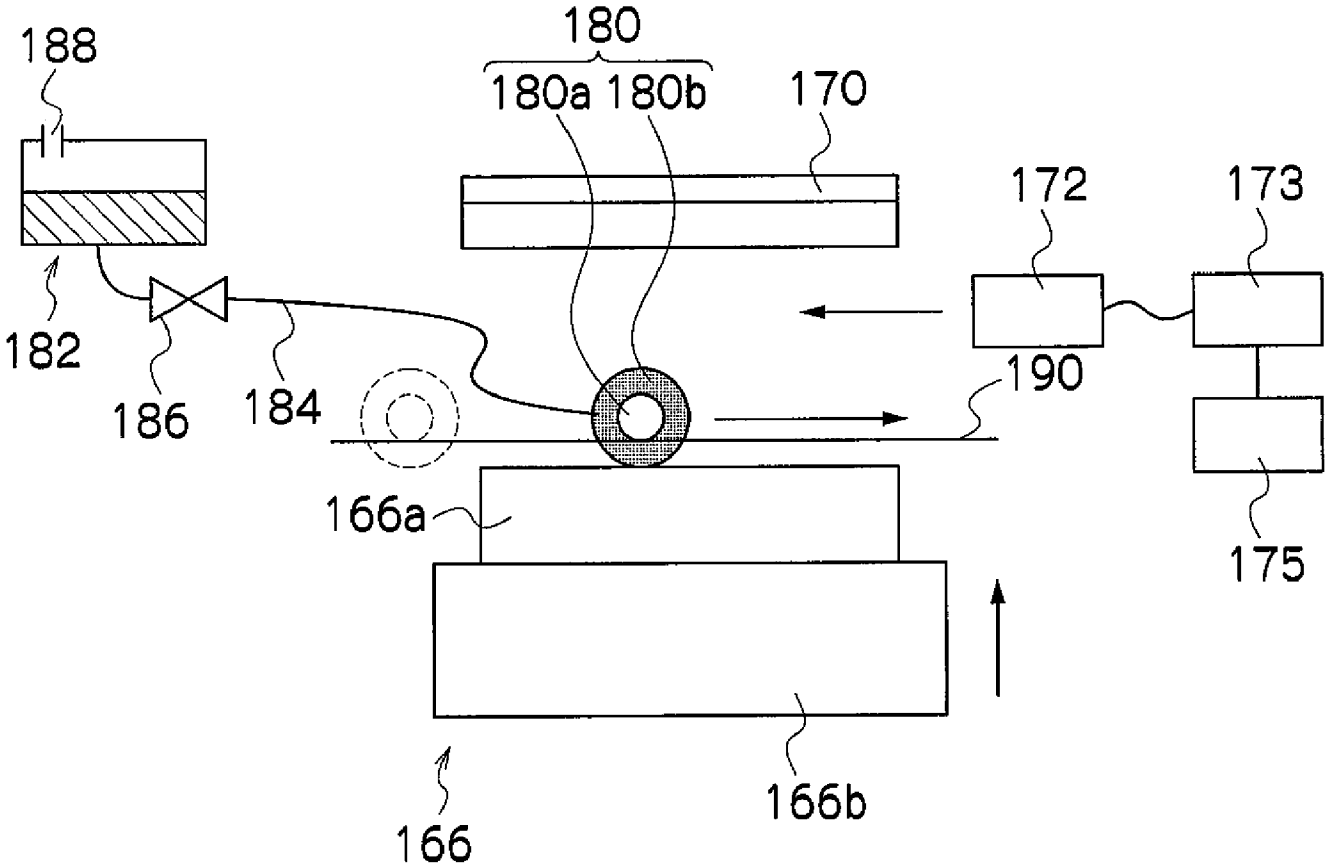
FIG. 13 is a compositional diagram showing an overview of an edge shape determination device for a wiping member of a cleaning apparatus in an inkjet recording apparatus according to a second embodiment of the present invention.

FIG. 13 shows the general composition of the edge shape determination device for a wiping member of a cleaning apparatus in the inkjet recording apparatus according to the present embodiment.

As shown in FIG. 13, similarly to the first embodiment, the cleaning apparatus for the print head nozzle surface according to the present embodiment is constituted by a wiper blade 166 comprising a wiping section 166*a* which is formed by an elastic member made of rubber, or the like, and a supporting section 166*b* which supports the wiping section 166*a* and can be moved over the nozzle surface (not shown), as well as being moveable in the vertical direction.

Furthermore, the device which determines the edge shape of the wiping section 166*a* comprises a determination plate 170 to which the edge trace of the wiping section 166*a* is transferred, a line CCD 172 which reads in an image of the edge trace that has been transferred to the determination plate 170, an image processing unit 173 which determines the edge shape by processing the acquired image of the edge trace, and a judgment unit 175 which judges the replacement timing for the wiping member on the basis of the determined edge shape.

Furthermore, in the present embodiment, an application device is provided in order to apply an application liquid for transferring the edge shape to the determination plate 170, onto the front tip portion of the wiping section 166*a*. The application device comprises an application roller 180 which applies the application liquid to the front tip portion of the wiping section 166*a* while moving along the front tip portion of the wiping section 166*a*, and an application liquid tank 182 and an application liquid supply pipe 184 for sending the application liquid to the application roller 180.

A valve 186 is provided at an intermediate position in the application liquid supply pipe 184, in such a manner that the supply of application liquid to the application roller 180 can be controlled. Furthermore, an air connection port 188 is provided in the application liquid tank 182. Moreover, the application roller 180 is constituted by a shaft 180*a* and an application member 180*b* which is formed about the shaft 180*a*. The application member 180*b* is made of a porous material, such as sponge, and the application liquid impregnated into the application member 180*b* is applied to the front tip portion of the wiping section 166*a*. Furthermore, the shaft 180*a* is rotated and moved along a guide rail 190.

Figure 14:
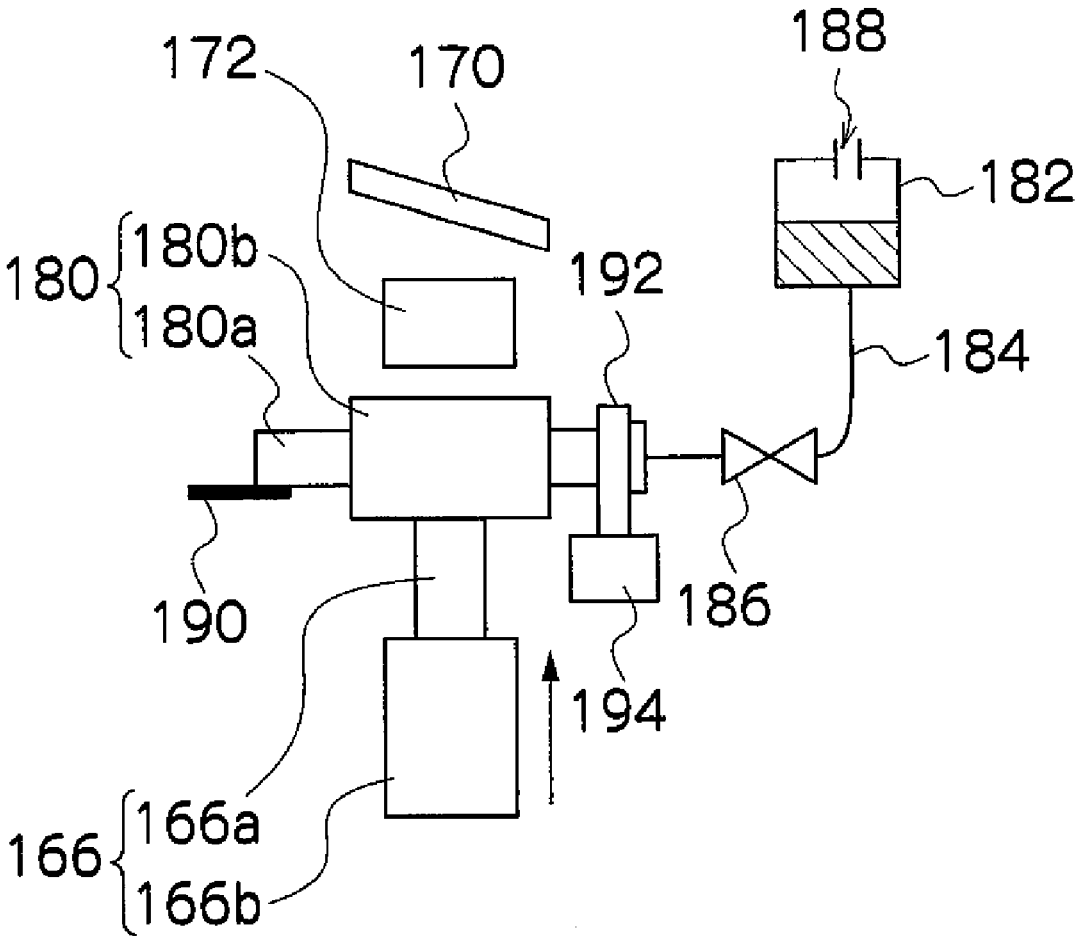
FIG. 14 is a right-hand side diagram of the edge shape determination device in FIG. 13.

FIG. 14 shows a right-hand side diagram of FIG. 13. As shown in FIG. 14, the shaft 180*a* of the application roller 180 is moved over the guide rail 190, in such a manner that the application member 180*b* makes contact with the front tip portion of the wiping section 166*a* of the wiper blade 166. Furthermore, a pinion gear 192 is formed on one end portion of the shaft 180*a*, and the application roller 180 is moved by means of this pinion gear 192 interlocking with a rack 194. In FIG. 13, the pinion gear 192 and the rack 194 are omitted from the illustration in order to avoid complications. Moreover, in FIG. 14, the judgment unit 175 is omitted from the drawing.

A hollow portion is formed inside the shaft 180*a*, and the application liquid is supplied from the application liquid tank 182 to this hollow portion, via the application liquid supply pipe 184. Furthermore, a plurality of connection ports which connect the hollow portion inside the shaft 180*a* to the application member 180*b* formed about the periphery of the shaft 180*a* are formed, so that the application liquid supplied to the hollow portion is supplied from the hollow portion to the application liquid 180*b*.

Moreover, when the nozzle surface of the print head is wiped, the wiper blade 166 is moved from the left-hand side toward the right-hand side in FIG. 14, though that is omitted from the drawings. When the wiper blade 166 has moved further after wiping the nozzle surface and has reached the position corresponding to the edge shape determination device and the application liquid application device shown in FIG. 14, then as indicated by the arrow in FIG. 14, the wiper blade 166 is moved upward in such a manner that the front tip portion of the wiping section 166*a* makes contact with the application member 180*b* of the application roller 180.

After completing the application of the application liquid by means of the application roller 180, the wiping blade 166 is moved further upward in a state where the application roller 180 has been moved to be deviated from a position above the wiper blade 166, and the front tip portion of the wiping section 166*a* is placed in contact with the determination plate 170. In this case, it is desirable that the determination plate 170 should be disposed at an oblique inclination, in such a manner that the right-hand side thereof is lower than the left-hand side thereof, since this enables more accurate confirmation of the edge shape of the right-hand side of the front tip portion of the wiping section 166*a*, in particular. This is because, as described above, the wiping action is performed while moving the wiper blade 166 from the left-hand side toward the right-hand side in FIG. 14, and therefore the right-hand edge of the front tip portion of the wiping section 166*a* is especially liable to suffer wear.

There are no particular restrictions on the angle at which the determination plate 170 is inclined, but it is, for example, disposed at an inclination of approximately 5 degrees to 30 degrees. Furthermore, although, in this case, the determination plate 170 is disposed at an oblique inclination, it is sufficient to apply a relative angle of contact between the front tip portion of the wiping section 166*a* and the determination plate 170, and therefore, it is also possible to dispose the determination plate 170 horizontally and, conversely, to dispose the wiping section 166*a* at an oblique inclination, and to cause the front tip portion of the wiping section 166*a* to abut obliquely when it makes contact with the determination plate 170. For example, in the first embodiment described above, it is also possible to dispose the wiping section 166*a* obliquely.

In a case where, as in the present embodiment, an application liquid is applied to a wiping member and the application liquid is then transferred onto the determination plate in order to transfer the edge trace, instead of depositing the ink wiped from the nozzle surface by the wiping member onto the determination plate, a special liquid having low viscosity and low surface tension can be used for the application liquid, for example, and therefore the liquid can be applied readily onto the wiping member, regardless of the properties of the ink. Ink having high viscosity or ink having high surface tension is not readily applied to the wiping member, but by using an application liquid instead of the ink, it becomes possible to apply the liquid readily to the wiping member.

In the examples described thus far, the edge trace is determined by depositing ink or an application liquid onto a determination plate, and determining the color of the actual ink or the application liquid, but rather than using the color of the ink or application liquid itself, it is also possible to use special materials for the determination plate and the application liquid, in such a manner that a color is created when the application liquid is deposited on the determination plate, and to then determine the color thus created. For example, if the application liquid is acidic or alkali, then it is possible to attach a sheet of paper impregnated with a solution which generates a color by reacting with the acid or alkali, to the surface of the determination plate. Consequently, since the color is generated in the portion with which the application liquid on the wiping member makes contact, then this can be read in by an imaging device.

Next, the method of determining the edge shape of a wiping member according to the present embodiment will be described following the flowchart in FIG. 15.

Figure 15:
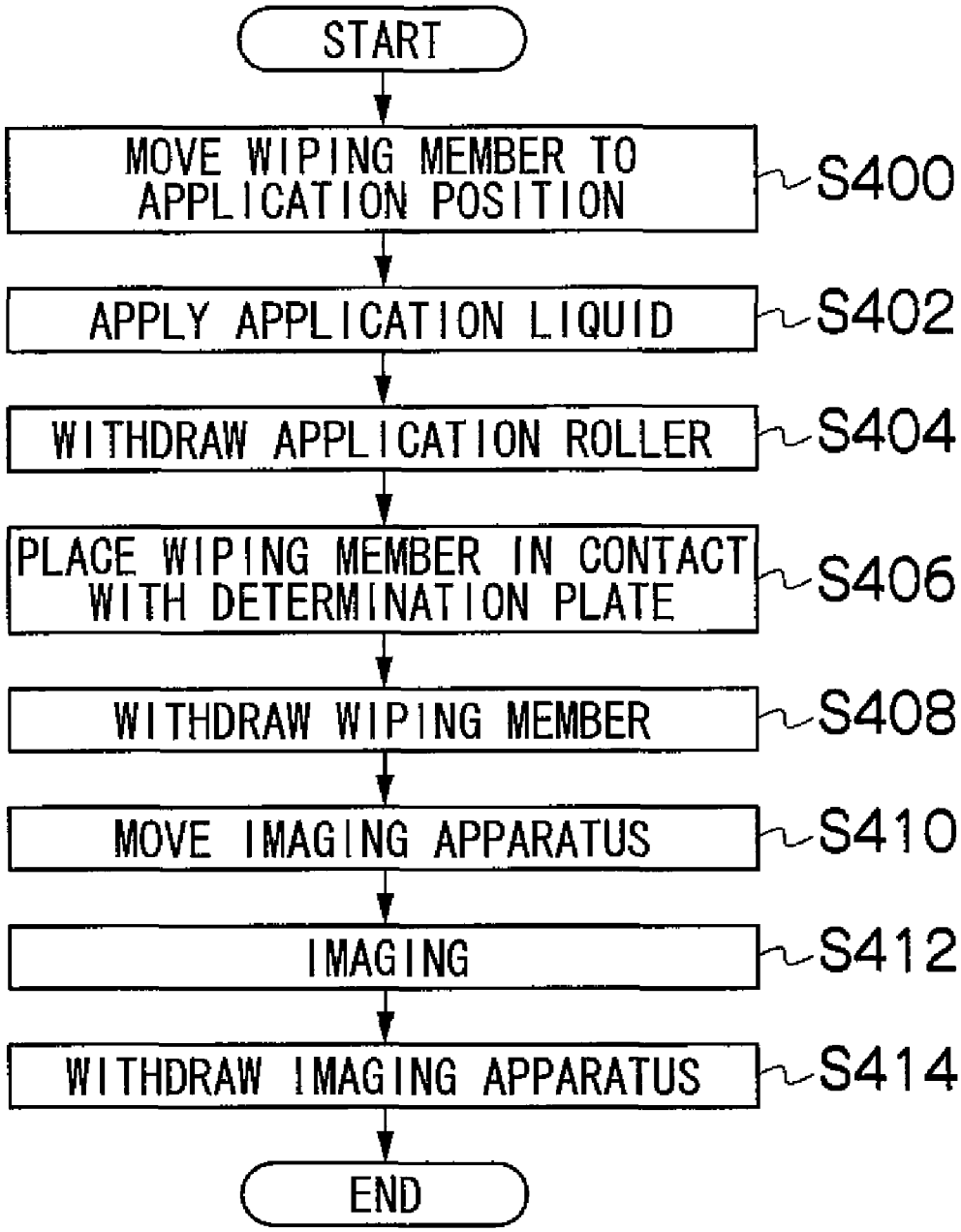
FIG. 15 is a flowchart showing an edge shape determination method for a wiping member according to the second embodiment.

Firstly, at step S400 in FIG. 15, the wiping member is moved to an application position. In the application position, the wiper blade 166, which is the wiping member, is halted in the state of abutting against the application member 180*b* of the application roller 180, as shown in FIG. 13 and FIG. 14. By this means, it is possible to prevent non-uniformities in the application of the application liquid onto the wiping section 166*a*.

Moreover, another method of determining the application position is one where the position of the wiping member can be controlled by means of a pulse motor, or the like, in such a manner that the wiping member is always moved to the same position. In either case, if the wiping member is always moved to a uniform position in order to apply the application liquid, then if the wiping member is suffering wear, the application liquid will not be applied and therefore the worn portion will not be transferred to the determination plate. Consequently, the wearing of the wiping member can be determined accurately.

In the example described above, the application device used for the application liquid is fixed, and the wiping member is moved to the position of the application device (the application position), so that application liquid can be applied. However, it is also possible to move the application roller 180 and the guide rail 190 to the wiping member after wiping the nozzle surface with the wiping member, in such a manner that application liquid is applied to the wiping member.

Next, at step S402, the application liquid is applied by the application roller 180 to the wiping member (wiping section 166*a*). The application liquid used may be, for example, an application liquid having low viscosity and/or low surface tension. By causing the pinion gear 192 to rotate on the rack 194 by means of a driving system, which is not shown in the diagram, the shaft 180*a* of the application roller 180 is moved while rotating over the guide rail 190. By this means, the application member 180*b* makes contact with the front tip portion of the wiping section 166*a*, and the application liquid impregnated into the application member 180*b* is applied to the portion of the wiping section 166*a* which makes contact with the nozzle surface (wiping surface).

Thereupon, at step S404, the application roller 180 is withdrawn. At step S406, the wiping member is moved in the direction of the determination plate 170 (the upward direction indicated by the arrow in FIG. 13 and FIG. 14), and the wiping member is placed in contact with the determination plate 170.

As described above, the determination plate 170 is disposed at an oblique inclination in such a manner that the side which strikes the wiping surface of the wiping member (in FIG. 14, the right-hand edge of the front tip portion of the wiping section 166*a*) is lower. Consequently, it is possible to transfer the edge shape of the wiping member accurately to the determination plate 170. In this case, if the angle of inclination at which the determination plate 170 is tilted is very large, then there is a possibility that the application liquid transferred to the determination plate 170 flows downward under the force of gravity. Therefore, the angle of inclination is desirably set to 5 to 30 degrees, as described above. In this case, similarly to the first embodiment described above, it is possible to determine the edge shape with a high degree of certainty, by managing the relative positional relationship between the wiping member and the determination plate.

Thereupon, at step S408, the wiping member is withdrawn, and at step S410, the imaging apparatus (line CCD 172) is moved to a position opposing the determination plate 170.

Next, at step S412, the edge trace created by the application liquid deposited onto the determination plate 170 is imaged by the line CCD 172 and the image read in is analyzed by the image processing unit 173. This is the same processing as in the image analysis routine described in the first embodiment.

Finally, at step S414, the imaging apparatus is withdrawn. Thereupon, using the results of imaging analysis, the judgment unit 175 judges the replacement timing of the wiping member.

The example described above with reference to FIG. 14 does not use a wiping action of the nozzle surface which involves rubbing the determination plate with the wiping member, but rather moves the wiping member upwards toward the determination plate and places the wiping member in contact with the determination plate. However, even if using an application liquid as in the present embodiment, it is possible to use a nozzle surface wiping action as in the first embodiment. In such a case, after the wiping member has finished wiping the print head, it is necessary to apply an application liquid before the edge trace is transferred to the determination plate, and therefore the application device for applying the application liquid is disposed between the print head and the determination plate.

Next, a third embodiment of the present invention will be described.

In the present embodiment, the edge shape is determined by measuring the pressing force when the wiping member is pressed against the determination plate, rather than determining the edge shape of the wiping member by transferring ink or an application liquid to the determination plate, and capturing an image of the resulting edge trace, as in the two embodiments described above.

Therefore, the determination plate of the present embodiment has a structure which allows the pressure upon contact with the wiping member to be determined.

Figure 16:
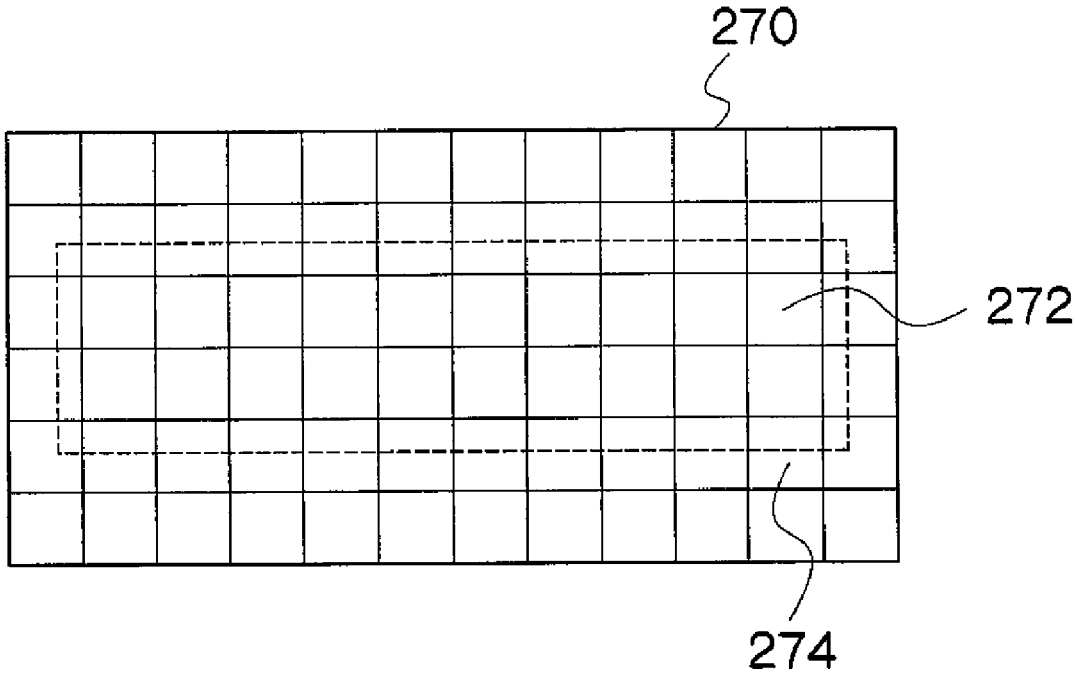
FIG. 16 is a plan diagram showing a determination plate according to a third embodiment of the present invention.

FIG. 16 is a plan diagram of a determination plate according to the present embodiment.

As shown in FIG. 16, the determination plate 270 according to the present embodiment is constituted by a lot of piezoelectric element cells 272. The range 274 indicated by the dotted lines in FIG. 16 is the range which makes contact with the wiping member.

Figure 17:
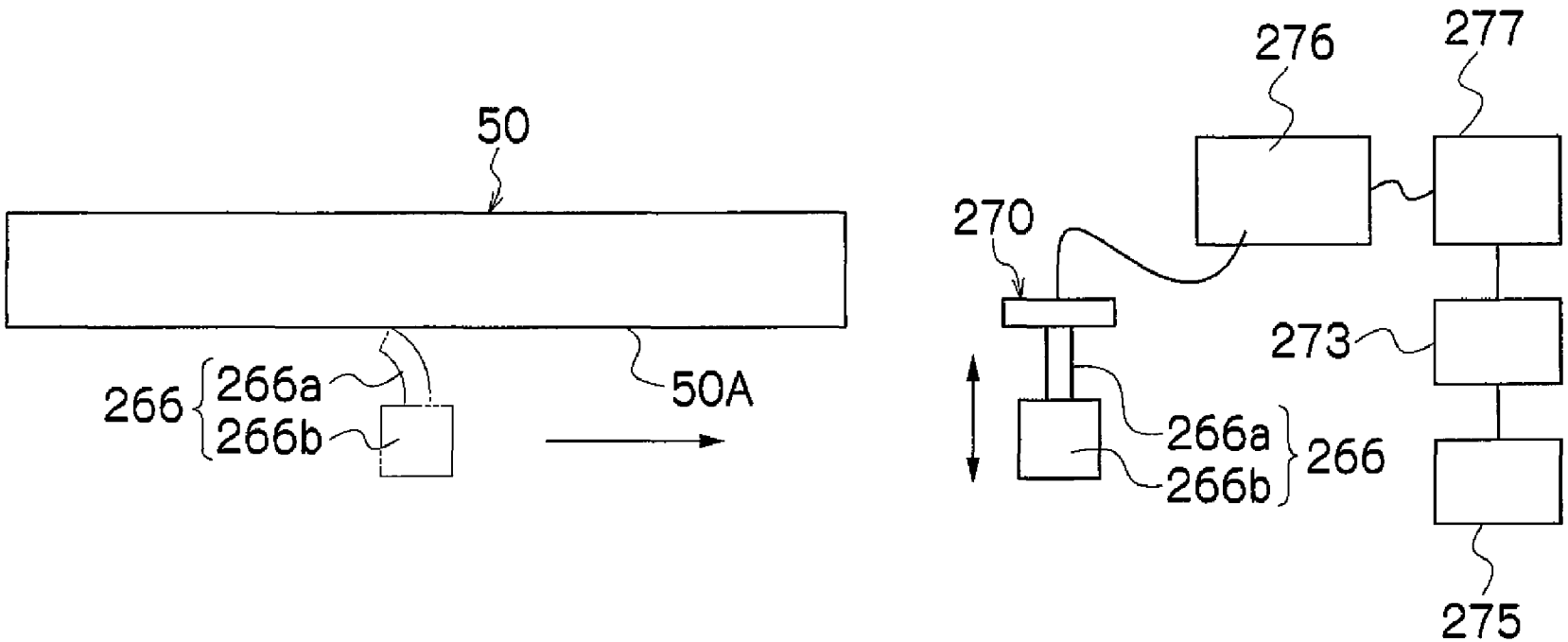
FIG. 17 is a compositional diagram showing an overview of a device for determining the edge shape of a wiping member relating to the third embodiment.

Furthermore, FIG. 17 shows an overview of an edge shape determination device according to the present embodiment.

As shown in FIG. 17, the edge shape determination device according to the present embodiment comprises: the determination plate 270 which is constituted by the piezoelectric element cells 272 as shown in FIG. 16; an amplifier 276 which amplifies the contact pressure of the wiping member determined by the determination plate 270; a signal processing unit 277 which converts the determination signals amplified by the amplifier 276 into image information; an image processing unit 273 which analyzes the converted image information to determine the edge shape; and a judgment unit 275 which judges the replacement timing of the wiping member on the basis of the determined edge shape.

The wiping member (wiper blade 266) which has wiped the nozzle surface 50A of the print head 50 is moved to the determination position and then it is moved in the vertical direction in such a manner that the front tip portion of the wiping section 266*a* is placed in contact with the determination plate 270, by a drive mechanism of the supporting section 266*b* (not illustrated), as indicated by the dotted line in FIG. 17.

The front tip portion of the wiping section 266*a* makes contact with the determination plate 270 in the range 274 indicated by the dotted line in FIG. 16, for example. The voltages in the respective piezoelectric element cells 272 which are contacted by the wiping member vary in accordance with the applied pressure. Signals indicating the positional information of the piezoelectric element cell 272 and the ratio of variation in the voltage are converted by the signal processing unit 277 into the image information, and the edge is determined by analyzing this image information in the image processing unit 273. The judgment unit 275 judges the need for replacement of the wiping member, and the replacement timing, on the basis of the determined edge shape.

In the case of the edge shape determination device according to the present embodiment, the wiping member is moved vertically to be placed in contact with the determination plate, and the contact pressure is measured. Therefore, it is possible to determine the edge shape regardless of the wiping operation of the wiping member.

In the present embodiment, the edge shape is determined by directly measuring the contact pressure of the wiping member on the determination plate, but it is also possible to determine the edge by using a pressure measurement film (for example, "Prescale" film made by FUJIFILM Corporation) which shows local variation in the density of color generation according to the applied pressure. By installing such a film on the surface of the determination plate, placing the wiping member in contact with the film, capturing an image of the density variation of the pressure measurement film by means of an imaging apparatus, and then analyzing the resulting image, the edge shape can be determined.

Liquid ejection apparatuses and methods of examining a cleaning apparatus of same according to the present invention are described in detail above, but the present invention is not limited to the aforementioned examples, and it is of course possible for improvements and modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a liquid ejection head which includes a nozzle plate forming a nozzle surface in which nozzles ejecting droplets of a liquid are provided;

a wiping member which wipes the nozzle surface;

an edge determination device which includes:

a determination plate having a determination plate surface with which a front tip portion of the wiping member wiping the nozzle surface can make contact, the determination plate surface and the nozzle surface being separate from each other;

an imaging device which captures an image of a contact trace left on the determination plate surface, the contact trace being created when the front tip portion of the wiping member is brought into contact with the determination plate surface so that the liquid having been ejected from the liquid ejection head and having become attached to the front tip portion due to wiping the nozzle surface is deposited on the determination plate surface; and an image processing unit which processes the captured image of the contact trace, the edge determination device determining an edge shape of the front tip portion of the wiping member according to the image of the contact trace;

a determination plate moving device which moves the determination plate upward and downward to adjust a height of the determination plate surface with respect to the nozzle surface; and a judgment device which judges timing of replacing the wiping member, according to the edge shape determined by the edge determination device, wherein the determination plate surface is placed higher than the nozzle surface by a distance that is larger than zero and smaller than an amount of overlap between the front tip portion of the wiping member and the nozzle plate surface.

2. The liquid ejection apparatus as defined in claim 1, wherein the judgment device compares a length of a missing edge part of the edge shape determined by the edge determination device, with a threshold value, to judge the timing of replacing the wiping member.

3. The liquid ejection apparatus as defined in claim 1, wherein the judgment device compares a ratio between a maximum value and a minimum value of width of the edge shape determined by the edge determination device, with a threshold value, to judge the timing of replacing the wiping member.

4. The liquid ejection apparatus as defined in claim 1, wherein the edge determination device further includes:

a plurality of piezoelectric elements which generate electrical signals when the wiping member makes contact with the determination plate surface; and a signal processing unit which converts the electrical signals generated by the plurality of piezoelectric elements into image information.

5. A method of inspecting a cleaning apparatus of a liquid ejection apparatus, comprising the steps of:

wiping a nozzle surface of a nozzle plate where nozzles ejecting droplets of liquid are formed, of a liquid ejection head, by means of a wiping member of the cleaning apparatus of the liquid ejection head;

bringing a front tip portion of the wiping member which has wiped the nozzle surface, into contact with a determination plate surface of a determination plate, the determination plate surface and the nozzle surface being separate from each other;

adjusting a height of the determination plate surface with respect to the nozzle surface, wherein the determination plate surface is placed higher than the nozzle surface by a distance that is larger than zero and smaller than an amount of overlap between the front tip portion of the wiping member and the nozzle plate surface;

determining an edge shape of the front tip portion of the wiping member by determining a contact trace of the front tip portion left on the determination plate surface; and judging timing for replacing the wiping member according to the determined edge shape of the front tip portion of the wiping member.

* * * * *